US008326174B2

(12) United States Patent
Naruse et al.

(10) Patent No.: US 8,326,174 B2
(45) Date of Patent: Dec. 4, 2012

(54) CLEANING UNIT FOR AN ELECTROPHOTOGRAPHIC IMAGE FORMING APPARATUS HAVING A POLARITY CONTROL MEMBER

(75) Inventors: Osamu Naruse, Yokohama (JP); Hidetoshi Yano, Yokohama (JP); Kenji Sugiura, Yokohama (JP); Naomi Sugimoto, Kawasaki (JP); Hiroki Nakamatsu, Fujisawa (JP)

(73) Assignee: Ricoh Company, Limited., Tokyo (JP)

( * ) Notice: Subject to any disclaimer, the term of this patent is extended or adjusted under 35 U.S.C. 154(b) by 325 days.

(21) Appl. No.: 12/659,649

(22) Filed: Mar. 16, 2010

(65) Prior Publication Data

US 2010/0239302 A1 Sep. 23, 2010

(30) Foreign Application Priority Data

Mar. 17, 2009 (JP) ..... 2009-063728

(51) Int. Cl.
*G03G 21/00* (2006.01)

(52) U.S. Cl. ..... 399/99; 399/343; 399/350; 399/351; 399/353; 399/354; 399/357

(58) Field of Classification Search ..... 399/99, 399/343, 350, 351, 353, 354, 357
See application file for complete search history.

(56) References Cited

U.S. PATENT DOCUMENTS

| | | | | |
|---|---|---|---|---|
| 2006/0056880 | A1* | 3/2006 | Okamoto | 399/284 |
| 2008/0193178 | A1* | 8/2008 | Sugimoto et al. | 399/354 |

FOREIGN PATENT DOCUMENTS

| | | |
|---|---|---|
| JP | 2000-162849 | 6/2000 |
| JP | 2003-058011 | 2/2003 |
| JP | 2004-212823 | 7/2004 |
| JP | 2005-017480 | 1/2005 |
| JP | 2005-241760 | 9/2005 |
| JP | 2008-197477 | 8/2008 |
| JP | 2008-197478 | 8/2008 |

* cited by examiner

*Primary Examiner* — Ryan Walsh
(74) *Attorney, Agent, or Firm* — Harness, Dickey & Pierce, P.L.C.

(57) ABSTRACT

A cleaning unit that can remove particles of residual toner remaining on an image carrier after transfer and be incorporated in a process cartridge removably installable to an image forming apparatus, includes a brush roller disposed in contact with the image carrier to remove the residual toner remaining on the image carrier from the image carrier, and a polarity control member disposed in contact with the image carrier to control charge polarities of the residual toner remaining on the image carrier before the residual toner is removed by the brush roller. The polarity control member includes a first surface where the polarity control member contacts the image carrier, a second surface where the polarity control member does not contact the image carrier, and a conductive filler that is not exposed on the first surface that contacts the image carrier.

16 Claims, 10 Drawing Sheets

CLEANING UNIT FOR AN ELECTROPHOTOGRAPHIC IMAGE FORMING APPARATUS HAVING A POLARITY CONTROL MEMBER

CROSS-REFERENCE TO RELATED APPLICATIONS

The present patent application claims priority pursuant to 35 U.S.C. §119 from Japanese Patent Application No. 2009-063728, filed on Mar. 17, 2009 in the Japan Patent Office, which is hereby incorporated by reference herein in its entirety.

BACKGROUND OF THE INVENTION

1. Field of the Invention

Example embodiments of the present patent application relate to a cleaning unit, a process cartridge incorporating the cleaning unit, and an electrophotographic image forming apparatus incorporating the cleaning unit, and more particularly, to a cleaning unit used to clean an image carrier having an electrostatic latent image formed thereon by electrophotographic, electrostatic recording, or electrostatic printing methods and the like employed in a process cartridge and an electrophotographic image forming apparatus such as a copier, printer, facsimile machine, etc.

2. Discussion of the Related Art

Electrophotography is an image forming method for forming electrostatic latent images by using an image carrier, a charging unit, an exposure unit, a developing unit, a transfer unit, and a cleaning unit. Firstly, the charging unit uniformly charges the surface of the image carrier to a positive or negative polarity and the exposure unit exposes the surface of the image carrier according to image data. The developing unit then develops the electrostatic latent image formed on the image carrier into a visible toner image with toner that is charged to a polarity opposite to that of the electrostatic latent image. The transfer unit transfers the toner image onto a recording medium or an intermediate transfer member. The cleaning unit removes residual toner remaining on the image carrier so that the now toner-less surface of the image carrier faces the charging unit and can be used repeatedly. Further, residual toner remaining on the surface of the intermediate transfer member is also removed; otherwise, when the toner image is transferred from the intermediate transfer member onto a recording medium in a secondary transfer, residual toner remaining on the surface of the intermediate transfer member can be also transferred onto the surface of the recording medium, resulting in production of background contamination of the final image.

To accomplish the above-described necessary toner removal, blade cleaning as well as conductive or insulating brush roller methods are known. The blade cleaning method for intercepting toner mechanically has been used conventionally since the configuration thereof is simple and inexpensive.

However, in recent years, in accordance with a demand for high resolution and high image quality, toner produced by polymerization has come to be used in place of the conventionally used toner produced by pulverization, since according to polymerization method can uniformly confine toner particle size within a narrow range and moreover high-sphericity particles of can be obtained. In the polymerization method, it is economically advantageous to use toner consisting essentially of spherical particles because their spherical shape requires no deformation processing. Further, toner having a spherical shape enhances transfer efficiency and reduces waste toner amounts, and therefore is more energy-efficient.

The nearly uniform spherical quality of polymerized toner particles has additional advantages. The forces that act on the surface of the image carrier when the toner adheres to the image carrier due to the latent electric potential and a development bias on the image carrier are the mirror force, which depends largely on the amount of electric charge and the distance between charges, and the Van der Waals force. The particles of pulverized toner obtained by conventional pulverization have a concavo-convex surface, whose convex portions are intensively charged by friction. By contrast, since the particles of polymerized toner produced by the polymerization method have a uniformly spherical or near-spherical shape, the surface of each particle is uniformly charged. This is because, in the pulverized toner, toner particles are in close contact with each other at the convex portions, that is, over extended areas, suggesting that much charge is concentrated in a very confined shape so that the mirror force increases. If, however, the toner has a spherical shape as in a polymerized toner, each particle of toner contacts every other particle at a point instead of a plane or other such shape. Therefore the charge amount in such confined regions of close contact is small, and thus the mirror force is weaker than that of the pulverized toner while the Van der Waals force is smaller than that of the pulverized toner.

Thus, in terms of contact force, due to its spherical shape, the particles of polymerized toner (hereinafter also simply "polymerized toner") has a relatively small attachment force, that is, a small mirror force and a small Van der Waals force, to a photoconductor. As a result, polymerized toner reduces the amount of residual toner remaining after transfer, thus reducing consumption of the toner and therefore provided an economic advantage.

However, when cleaning the residual toner, the polymerized toner, which has a small particle diameter and spherical shape, tends to pass beneath the blade, or put another way, through a gap formed between the edge of the blade and the surface of the image carrier. Therefore, in order to remove the polymerized toner remaining on the image carrier, it is necessary to press the blade against the surface of the image carrier with enough force to intercept the toner. However, strongly pressing the blade against the image carrier accelerates abrasion of both the blade and the image carrier. In particular, to obtain good transferability when an image is transferred onto a recording medium having an uneven surface, an elastic member such as a transfer belt has been gradually come to be used for the transfer member. The ability of the blade to clean such an elastic belt (hereinafter also "cleaning ability") is unimpaired initially. However, as time elapses, the cleaning ability of the blade is likely to deteriorate.

Moreover, pressing the blade against the image carrier with force necessitates a correspondingly large torque be generated by a motor for driving the image bearing member, necessitating a larger and more expensive motor.

For the reasons discussed above, as an alternative to the blade-based configuration a cleaning method for cleaning a small-sized, peripheral toner without causing damage to the image carrier using an electrostatic brush roller that attracts toner by electrostatic force has been considered.

In related-art cleaning units employing an electrostatic brush make use of the fact that the residual toner after transfer still has an electric charge, and thus the toner is adsorbed and removed by the brush to which a bias voltage of a polarity that is the reverse of the polarity of the residual toner is applied. However, it is to be noted that the electric charge of the residual toner can be either positive or negative by discharging, and is usually both depending on the particle. Since in general the bias voltage applied at transfer step is positive, the negative polarity toner after development is adsorbed and transferred while the positively polarity toner is not transferred and passes through to a post-process.

As described above, discharging occurs between the recording media due to a voltage for transfer, resulting in the co-existence of toner of positive and negative polarities and not simply toner of either one or the other polarity alone. Accordingly, there are related-art devices in which a bias voltage of positive or negative polarity is applied to the toner by use of a bias voltage applying unit such as a brush.

In addition, there is another method in which the polarity is made uniformly positive or negative with the use of a polarity control unit and a voltage reverse to the unified polarity is applied to a cleaning unit to adsorb the toner. The polarity control unit changes the polarity by contacting the toner. It is also to be noted that there is also a non-contact type method in which ions are attached to the outer surface of the toner particles by ionic irradiation such as corona discharge. However, this method has a serious drawback in that the high-voltage discharge generates not only ions but also ozone, which is harmful to humans and to the environment.

In the contact method, the electric charge is controlled by frictional charge, charge injection, or the like, without causing discharge. Specifically, the polarity change is carried out by contacting the toner with a conductive brush, a conductive blade, or the like.

However, in the case of using a brush, the toner tends to adhere to the brush, partially blocking the discharging onto the surface to be biased to unify the polarity and making the polarity uncontrollable over time. In the case of using a blade, the force of contact of the blade against the image carrier causes abrasive degradation in both the image carrier and the blade, which method is therefore problematic in terms of durability.

Consequently, since the blade is originally used to scrape away residual toner, the blade is effectively used to reduce load to the brush when a large amount of residual toner after transfer is conveyed. The toner adhering to the brush is electrostatically conveyed to a toner collection roller that is held in contact with the brush. The toner attached to the toner collection roller is again scraped away by the blade.

Despite the problems associated with polarity control, given its advantages it is not surprising that various types of cleaning units that include a polarity control member have been proposed.

One approach, for example, discloses that a cleaning unit includes a collecting roller to collect toner having a positive polarity and toner having a negative polarity, both of which adhere to a cleaning brush. The collecting roller serves as a high-resistance collecting roller including an electrically conductive member and a surface layer composed of an insulating member formed over the electrically conductive member. The cleaning unit applies a voltage having the same polarity as the voltage applied to the collecting roller to a cleaning member for cleaning the surface of the collecting roller that is held in contact with the surface of the collecting roller. Thus, electrical charge is applied to the surface of the collecting roller. However, the change of polarity of the electric charge applied onto the surface of the collecting roller is to improve the collectivity of toner adhering to the brush roller. Therefore, this technique is not effective for toner the polarity of which cannot be controlled due to deterioration of the polarity control blade.

Another approach discloses that a cleaning unit including a cleaning brush is charged with a voltage opposite to the voltage of the cleaning brush. As a result, both the toner charged to a negative polarity and the toner charged to a positive polarity on the surface of a target body to be cleaned can be attracted to the fibers of the cleaning brush. This approach offers the possibility that toner that passes through the cleaning brush while adhering to the target body but without attaching to the brush fibers can be substantially eliminated, and therefore can prevent poor cleaning. However, this approach does not enhance the cleaning ability and does not improve the durability of the cleaning unit.

Yet another approach discloses an image forming apparatus in which a charge control agent for changing the electrostatically charged polarity of toner, which is reversed due to transfer of a toner image by a transfer roller onto a recording medium, to the same polarity as that of the photoconductor is imparted to an electrostatic charging brush (brush contact) that is held in contact with the surface of the photoconductor. Accordingly, adhesion of residual toner to the photoconductor after transfer is prevented. This can enhance toner collectivity of the residual toner on a developing roller of a developing unit and a constant amount of charge can be maintained for an extended period of time. That is, the cleaning unit collects residual toner to a developing unit by charging to one polarity using a charging member. However, since a brush is used as the charging member, when a large amount of residual toner is conveyed thereto, the cleaning unit cannot collect the residual toner sufficiently, which can result in poor cleaning.

Yet another approach discloses that an image forming apparatus includes a cleaning unit that cleans an electrophotographic photoconductor and that includes at least one brush roller disposed on the surface of the electrophotographic photoconductor and composed of string-shaped brush fibers, each having a surface roughness Ra in a range of 0.15 micrometers [μm]≦Ra≦3.5 micrometers [μm]. Such a cleaning method electrostatically attracts particles of toner having different polarities by using two brushes. However, a gap is formed between the brushes, and therefore a large amount of residual toner remaining after transfer of a solid image cannot be cleaned sufficiently, and even the initial performance may become poor.

The most significant issue of the related-art cleaning unit using the polarity control member described above is poor durability in long-term image forming. The polarity control member is required to scrape toner from the surface of the photoconductor and provide a single polarity, which is a positive polarity or a negative polarity, to toner passing through the cleaning area, and therefore should be robust. However, long-term image forming can cause the edge of the blade to be nicked or gouged, allowing toner to pass under the blade in streaks. The inventors have found that, under these conditions, the toner cannot receive any polarity control, which can result in streaky cleaning defect. Further, another disadvantage is that the toner that has managed to pass under the blade also tends to adhere to the surface of the blade.

SUMMARY OF THE INVENTION

Example aspects of the present patent application have been made in view of the above-described circumstances.

Example aspects of the present patent application provide a cleaning unit that can effectively remove residual toner remaining on a photoconductor or an intermediate transfer belt even after long-term image forming, and avoid poor cleaning caused by toner particles of the residual toner passing beneath a cleaning blade having a nicked edge and prevent fixation of the toner particles on a surface of the cleaning blade.

Other example aspects of the present patent application provide a process cartridge that can incorporate the above-described cleaning unit.

Other example aspects of the present patent application provide an image forming apparatus that can incorporate the above-described cleaning unit and/or the above-described process cartridge.

In one example embodiment, a cleaning unit for removing particles of residual toner remaining on an image carrier after transfer includes a brush roller disposed in contact with the image carrier to remove the particles of the residual toner remaining on the image carrier from the image carrier, and a polarity control member disposed in contact with the image carrier to control charge the polarities of the residual toner remaining on the image carrier before the residual toner is removed by the brush roller. The polarity control member includes a first surface where the polarity control member contacts the image carrier, a second surface where the polarity control member does not contact the image carrier, and a conductive filler that is not exposed on the first surface that contacts the image carrier.

The polarity control member may be a polarity control blade.

The polarity control member may be free of the conductive filler in a vicinity of the first surface of the polarity control member where the polarity control member contacts the image carrier.

The quantity of the conductive filler may gradually increase from the vicinity of the first surface of the polarity control member toward the second surface of the polarity control member.

The polarity control member may further include an ion conductor. The cleaning unit may further include a blade supporting member to support the polarity control member, and a migration prevention layer between the polarity control member and the blade supporting member to prevent loss of the ion conductor.

The migration prevention layer may be free of the ion conductor.

A volume resistivity of the first surface of the polarity control member may be $1.0\times10^7$ Ω·cm or greater.

The polarity control member may be fabricated using a centrifugal molding technique by adding at least the conductive filler to a thermosetting polyurethane resin.

The polarity control member may have an exposed surface that the image carrier contacts.

The polarity control member may be fabricated using a centrifugal molding technique involving first processing a composition consisting essentially of a thermosetting polyurethane resin and then adding at least the conductive filler to the processed composition.

The polarity control member may include a thermosetting polyurethane resin. The polarity control member may be fabricated using a centrifugal molding technique involving first processing a first composition consisting essentially of a non-conductive material and then adding a second composition consisting essentially of a thermosetting polyurethane resin having at least the conductive filler to the processed first composition.

Further, in one example embodiment, a process cartridge is removably installable to an image forming apparatus and incorporates an image carrier to carry an electrostatic latent image on a surface thereof, and the above-described cleaning unit. The image carrier and the cleaning unit are integrally incorporated into and supported in the process cartridge.

Further, in one example embodiment, an electrophotographic image forming apparatus that can incorporate an image carrier to carry an electrostatic latent image formed on a surface thereof, a developing unit to develop the electrostatic latent image formed on the surface of the image carrier into a visible toner image, and the above-described cleaning unit.

The above-described electrophotographic image forming apparatus may further include the above-described process cartridge integrally including at least the image carrier and the above-described cleaning unit.

The residual toner on the image carrier may have a shape factor SF-1 of 100 to 150 and a volume average particle diameter of 6 micrometers or less.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
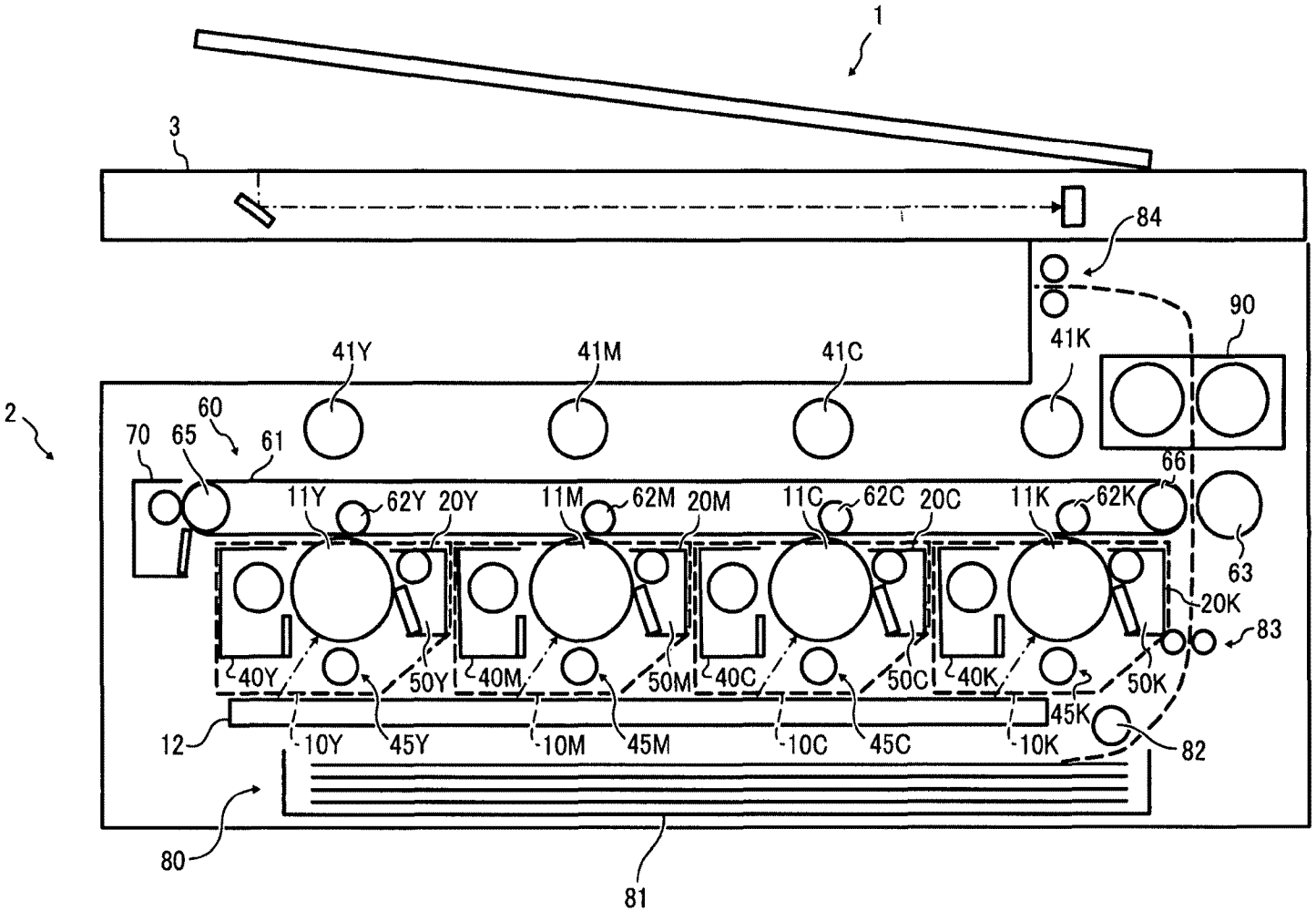
FIG. 1 is a schematic configuration of an image forming apparatus according to an example embodiment of the present patent application.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present patent application.

The terminology used herein is for the purpose of describing particular embodiments only and is not intended to be limiting of the present patent application. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Now, example embodiments of the present patent application are described in detail below with reference to the accompanying drawings.

Descriptions are given, with reference to the accompanying drawings, of examples, example embodiments, modification of example embodiments, etc., of an image forming apparatus according to the present patent application. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present patent application.

The present patent application includes a technique applicable to any cleaning unit, process cartridge, and image forming apparatus. For example, the technique of the present patent application is implemented in the most effective manner in an electrophotographic image forming apparatus incorporating a process cartridge having a cleaning unit.

In describing preferred embodiments illustrated in the drawings, specific terminology is employed for the sake of clarity. However, the disclosure of the present patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent application are described.

FIG. 1 illustrates a schematic configuration of an image forming apparatus 1 according to an example embodiment of the present patent application.

With reference to FIG. 1, basic configuration and operations of the image forming apparatus 1 are described.

The image forming apparatus 1 can be any of a copier, a printer, a facsimile machine, a plotter, and a multifunction printer including at least one of copying, printing, scanning, plotter, and facsimile functions. In this non-limiting example embodiment, the image forming apparatus 1 functions as a full-color copying machine employing a tandem-type image forming mechanism with an intermediate transfer belt for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

Since units and components with respective suffixes generally have similar configurations to each other, except for the colors of toners, it is also referred to without specific suffixes. At the same time, components and units provided in devices are denoted by common reference numerals without suffixes "Y", "M", "C", and "K" that are generally used to distinguish the colors.

In FIG. 1, the image forming apparatus 1 includes an image reading device 3, a sheet feeding device 80, an image forming mechanism 2, a transfer unit 60, an optical writing device 12, and a fixing unit 90.

The image reading device 3 is disposed at an upper part of the image forming apparatus 1 to read image data based on an original document.

The sheet feeding device 80 is located at the lower part of the image forming apparatus 1 of FIG. 1 and mainly includes a sheet feeding cassette 81 to accommodate transfer sheets including a transfer sheet serving as a recording medium therein.

The image forming mechanism 2 is located above the sheet feeding device 80 and includes image forming units or process cartridges 10Y, 10M, 10C, and 10K (hereinafter, also referred to as a "process cartridge 10") including image carriers or photoconductors 11Y, 11M, 11C, and 11K (hereinafter, simply referred to as a "photoconductor 11" without the suffixes when the color does not to be specified), respectively. The photoconductor 11 serves as an image carrier to carry or bear an image on a surface thereof.

The optical writing device 12 forms an electrostatic latent image on the photoconductor 11. Consequently, the electrostatic latent image is developed into a visible toner image.

The transfer unit 60 includes an intermediate transfer belt 61 serving as an image carrier and also an intermediate transfer member including a flexible, endless belt. The intermediate transfer belt 61 is spanned around the multiple supporting rollers 65 and 66. The intermediate transfer belt 61 receives the visible toner image from the photoconductor 11 and transfers the toner image onto the transfer sheet.

The fixing unit 90 fixes the toner image to the transfer sheet by application of heat and pressure.

A sheet conveyance path is formed from the sheet feeding cassette 81 to the fixing unit 90. While traveling through the conveyance path, the transfer sheet is fed one by one from the sheet feeding cassette 81 by a sheet feeding roller 82 and conveyed to a pair of registration rollers 83 where the transfer sheet is stopped and further conveyed toward the transfer unit 60 in synchronization with movement of the intermediate transfer belt 61.

A lower part of the intermediate transfer belt 61 wound around the multiple supporting rollers 65 and 66 corresponds to a lower surface of the intermediate transfer belt 61.

A secondary transfer roller 63 serving as a secondary transfer member is disposed at a location facing the supporting roller 66, so that the transfer sheet conveyed along the sheet conveyance path to an area between the secondary transfer roller 63 and the supporting roller 66 can receive a composite toner image.

A belt cleaning unit 70 is disposed at a location facing the supporting roller 65 so as to clean the surface of the intermediate transfer belt 61 by removing residual toner remaining on the surface of the intermediate transfer belt 61.

The image forming units 10Y, 10M, 10C, and 10K are arranged along the lower surface of the intermediate transfer belt 61 so that the photoconductors 11Y, 11M, 11C, and 11K face the intermediate transfer belt 61.

Various units and components are disposed around the photoconductor 10. For example, a charging unit 45 that includes a charging roller 46, a developing unit 40 that includes a development sleeve, and a cleaning unit 20 that includes a brush roller 25.

Primary transfer rollers 62Y, 62M, 62C, and 62K (hereinafter, referred to as a primary transfer roller 62), which serve as primary transfer members, are arranged to contact the inner surface of the intermediate transfer belt 61 to face the photoconductors 11Y, 11M, 11C, and 11K, respectively, via the intermediate transfer belt 61.

As described above, the image forming apparatus 1 includes four image forming units 10Y, 10M, 100, and 10K, which respectively form yellow (Y), cyan (C), magenta (M), and black (K) toner images. Each of the image forming units 10Y, 10M, 10C, and 10K have similar structure and functions, except for different toner colors.

The optical writing device 12 that is disposed at a lower part of the image forming unit 10 in FIG. 1 exposes the surface of the photoconductor 11 by irradiating an optically demodulated laser light beam L to the surface of the photoconductor 11, so that an electrostatic latent image is formed on the surface of the photoconductor 11.

The image forming apparatus 1 further includes toner bottles 41Y, 41M, 41C, and 41K (hereinafter referred to as a "toner bottle 41" unless the color of toner is not specified) at an upper part thereof in FIG. 1. Generally, toner is replenished by replacement of the toner bottle 41 and the image forming unit 10 is replaced only when the photoconductor 11, the charging unit 45, and so forth should be replaced.

The toner bottle 41 shown in FIG. 1 is disposed at the upper part of the image forming apparatus 1 to convey toner to the image forming unit 10 to supply the toner. With this configuration, toner can be replenished not by replacing the entire image forming unit 10 but by replacing the toner bottle 41 only, which can reduce the cost to user.

In addition, by reducing the number of opening and closing the covers provided on the image forming apparatus 1 and the number of ejecting and retracting the cassettes or units, toner scattering that can occur at the shutter parts can be prevented, and the image forming unit 10 can be replaced easily. Therefore, the image forming unit 10 can be quickly replaced at the end of its life or at the mechanical failure, which can enhance ease of maintenance.

Next, a description is given of operations of image forming with the image forming apparatus 1 according to an example embodiment of the present patent application.

When the image forming operation starts, a drive unit, not illustrated, rotates the photoconductor 11 of the image forming unit 10 in a clockwise direction and the charge roller 46 uniformly charges the surface of the photoconductor 11. The optical writing device 12 emits the laser light beam L to irradiate the charged surface of the photoconductor 11 so as to form an electrostatic latent image thereon. At this time, for example, the document reading device 3 reads data of the image of a given full-color original document, and an arithmetic device calculates and separates the read image data of full color into each color data of yellow, cyan, magenta, and black. The image data exposed to the photoconductor 11 is single color image data separated based on the full color image data. The electrostatic latent image formed as above is developed into a visible toner image by the developing unit 40 with corresponding single toner accommodated in the developing unit 40 when the transfer sheet passes through an area formed between the photoconductor 11 and the developing unit 40.

A drive unit, not illustrated, rotates one of the multiple supporting rollers 65 and 66 wound around the intermediate transfer belt 61 in a counterclockwise direction as shown in FIG. 1. By so doing, the intermediate transfer belt 61 moves and the other rollers are rotated with the movement of the intermediate transfer belt 61. The single color toner images that are formed on each of the image forming units 10 are sequentially transferred by the primary transfer roller 62 and overlaid on the surface of the intermediate transfer belt 61 that moves as described above, so that a full-color toner image is formed on the surface of the intermediate transfer belt 61.

Residual toner remaining on the surface of the photoconductor 11 after primary transfer is removed by the photoconductor cleaning unit 20 from the surface thereof. The surface of the photoconductor 11 is then electrically discharged by a discharging unit, not illustrated, to initiate a potential on the surface of the photoconductor 11 to prepare for a subsequent image forming operation.

By contrast, the transfer sheet fed from the sheet feeding tray 81 is conveyed to the sheet conveyance path. The pair of registration rollers 83 disposed on the sheet feeding side from the secondary transfer roller 63 stops and then conveys the transfer sheet further to a secondary transfer nip or a contact area formed between the supporting roller 66 and the secondary transfer roller 63 at a sheet feed timing or in synchronization with movement of the intermediate transfer belt 61. At this time, the secondary transfer roller 63 is applied with a transfer voltage having a polarity opposite the toner charge polarity of the toner image formed on the surface of the intermediate transfer belt 61. By so doing, the toner image formed on the surface of the intermediate transfer belt 61 is transferred onto the transfer sheet.

The transfer sheet having the toner image thereon is conveyed to the fixing unit 90, where heat and pressure are applied to the toner image when the transfer sheet passes through the fixing unit 90 to fix the toner image to the transfer sheet.

The transfer sheet fixed with the toner image or the printed sheet is conveyed to a sheet discharging roller 84 that is located at the end of the sheet conveyance path provided at the upper portion of the image forming apparatus 1, and further convened to a sheet stacker provided at the upper part of the image forming apparatus 1. Residual toner remaining on the surface of the intermediate transfer belt 61 after secondary transfer of the image is removed by the belt cleaning unit 70 and cleaned for a subsequent image forming operation.

Thus, the four image forming units 10 of the image forming apparatus 1 are arranged to face the intermediate transfer belt 61 to sequentially transfer and overlay the single toner images onto the intermediate transfer belt 61. Therefore, this configuration having four image forming units 10 is more advantageous to a great reduction in time for image forming than a configuration in which one image carrier with four-color developing units transfer toner images sequentially onto an intermediate transfer belt and then onto a transfer sheet.

Further, the sheet stacker is provided at the upper part of the image forming apparatus 1, and therefore the sheet stacker in this configuration does not project from the image forming apparatus 1 and can reduce the installation area and occupied area.

The explanation as above relates to image forming operations when forming a full-color image on a transfer sheet. However, any one of the image forming units 10 of the image forming mechanism 2 can form a single color toner image or multicolor toner image such as a two-color toner image and three-color toner image.

Further, when printing a monochrome image using the image forming apparatus 1 according to an example embodiment of the present invention, an electrostatic latent image is formed on the photoconductor 11K of the image forming unit 10K only, developed into a visible toner image, transferred onto the intermediate transfer mechanism 60, and fixed to the transfer sheet in the fixing unit 90.

Further, the image forming unit 10 corresponds to a so-called process cartridge and integrally includes the photoconductor 11, the developing unit 40, the photoconductor cleaning unit 20, and the charging unit 45.

Next, detailed descriptions are given of the photoconductor cleaning unit 20 and the belt cleaning unit 70.

Residual toner remaining on the surface of the photoconductor 11 is collected by the cleaning unit 20 so that the surface of the photoconductor 11 can be used repeatedly for image forming. Further, the belt cleaning unit 70 cleans the surface of the intermediate transfer belt 61 after secondary transfer by removing foreign materials such as residual toner and powder remaining on the intermediate transfer belt 61.

Figure 2:
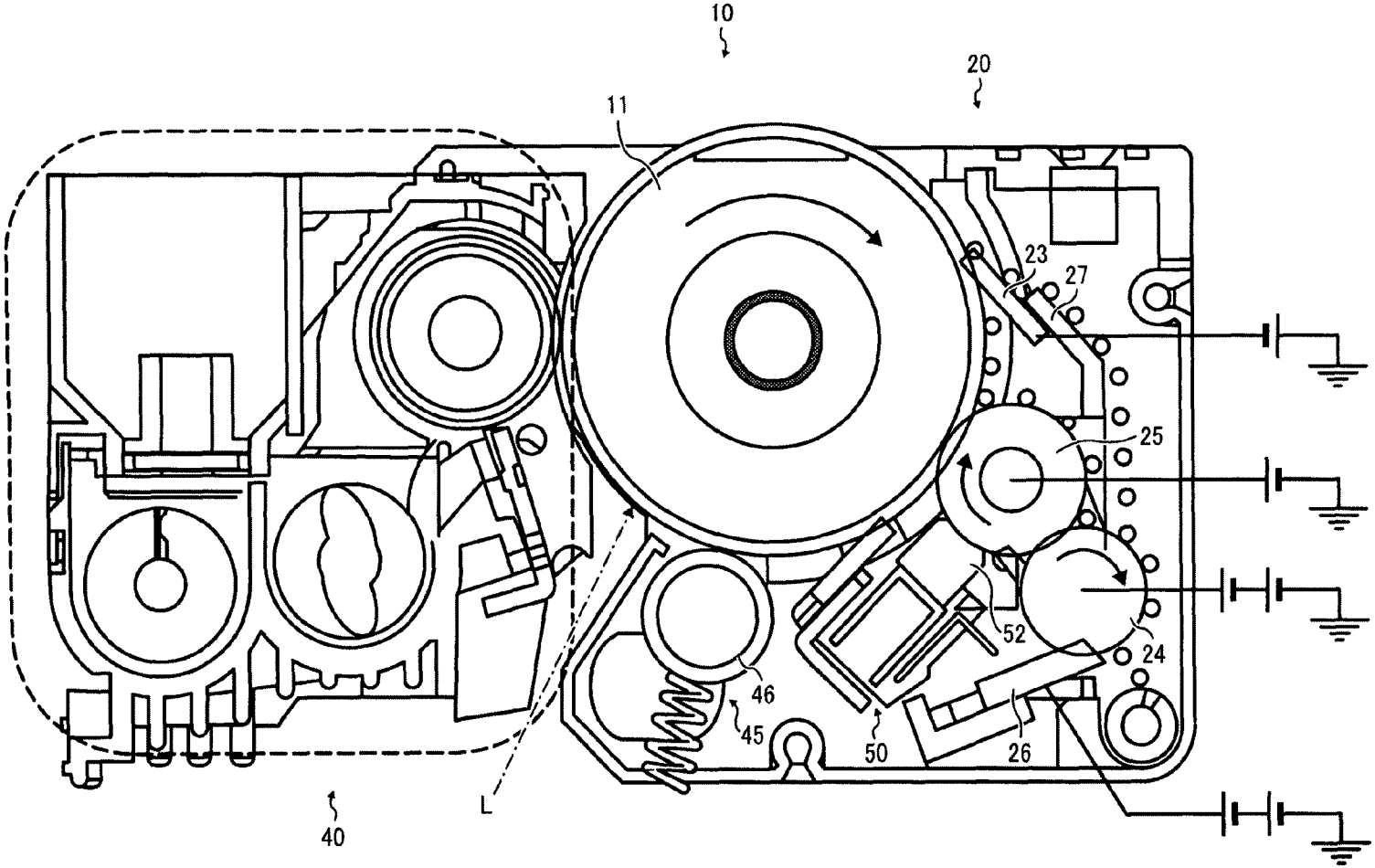
FIG. 2 is a schematic configuration of a photoconductor cleaning unit incorporated in the image forming apparatus of FIG. 1.

FIG. 2 illustrates a schematic configuration of a photoconductor cleaning unit 20 for cleaning the photoconductor 11, according to an example embodiment of the present patent application.

In FIG. 2, the photoconductor 11, the charging unit 45, the developing unit 40, and the photoconductor cleaning unit 20 are integrally incorporated in the image forming unit 10. The image forming unit 10 is removably installable to the image forming apparatus 1 and is easily replaceable.

The photoconductor cleaning unit 20 includes a polarity control blade 23, a toner collection roller 24, a brush roller 25, and a toner collecting blade 26.

Figure 3:
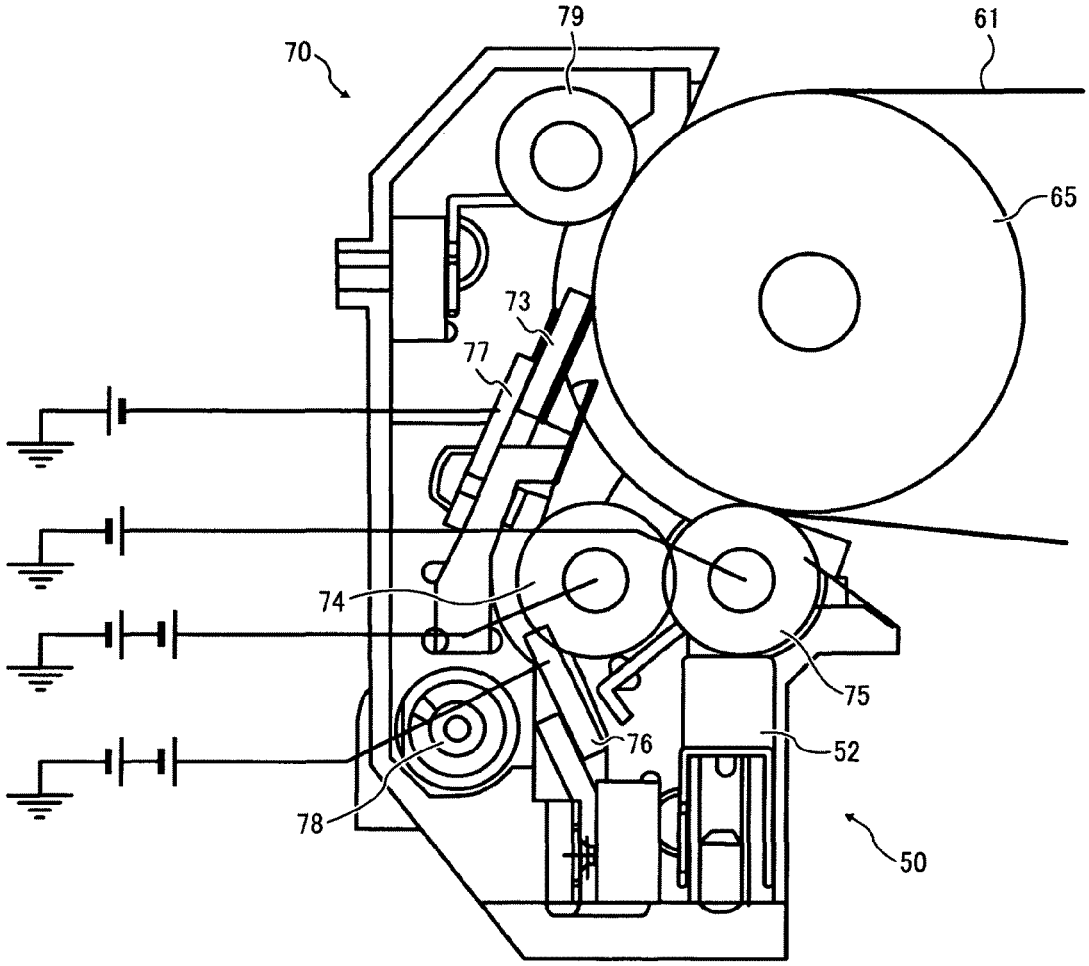
FIG. 3 is a schematic configuration of a belt cleaning unit incorporated in the image forming apparatus of FIG. 1.

FIG. 3 illustrates a schematic configuration of a belt cleaning unit 70 for cleaning the intermediate transfer belt 61, according to an example embodiment of the present patent application.

The belt cleaning unit 70 includes a polarity control blade 73, a toner collection roller 74, a brush roller 75, a toner collection blade 76, a blade supporting plate 77 serving as a blade supporting member.

The belt cleaning unit 70 cleans the surface of the intermediate transfer belt 61 by removing residual toner remaining of the surface thereof. The function of the belt cleaning unit 70 is basically same as that of the photoconductor cleaning unit 20. Similarly, the function of the polarity control blade 73 is basically same as that of the polarity control blade 23 of the photoconductor cleaning unit 20, and the function of the brush roller 75 is basically same as that of the brush roller 25 of the photoconductor cleaning unit 20.

Further, a powder collecting roller 79 is disposed at the most upstream portion.

A primary brush roller 78 is disposed at a lower part of the belt cleaning unit 70 to remove powder and talc that fall from the transfer sheet by contacting the intermediate transfer belt 61.

The cleaning mechanism of the photoconductor cleaning unit 20 according to an example embodiment of the present patent application will be described below.

The photoconductor cleaning unit 20 and the belt cleaning unit 70 according to an example embodiment of the present patent application can be applied to any of the photoconductor 11 and the intermediate transfer belt 61 as an image carrier for carrying images. However, the following descriptions are made to use mainly for the photoconductor 11.

The photoconductor cleaning unit 20 and the belt cleaning unit 70 according to an example embodiment of the present patent application can be also applied to a charging roller of the charging unit 45, a fixing roller and a fixing belt of the fixing unit 90, and the like.

It is also preferable that each of the cleaning unit 20 and the belt cleaning unit 70 includes a lubricant application unit 50. The lubricant application unit 50 includes a lubricating blade and a lubricating brush roller, i.e., the lubricating brush roller 25 and the lubricating brush roller 75. The lubricating blade includes a polyurethane rubber that has a given repulsion elasticity, which is 50% in this case, and a given Hs hardness, which is 70 in this case, and is held in contact with the photoconductor 11 at a given line pressure, which is 18 gf/cm in this case. The lubricating brush roller 25 or 75 scrapes solid lubricant 52 to supply the scraped lubricant onto the surface of the photoconductor 11. After the cleaning unit 20 cleans the surface of the photoconductor 11, the lubricating brush roller 25 or 75 supplies fine particles of lubricant scraped from the solid lubricant 52 onto the surface of the surface of the photoconductor 11 so that the lubricating blade can regulate the scraped lubricant applied onto the surface of the photoconductor 11 evenly.

According to this action, the coefficients of friction on the surface of the photoconductor 11 are reduced evenly, the lubricant applied onto the surface of the photoconductor 11 can serve as a protection film thereof to prevent filming, and therefore can prevent deterioration of the photoconductor 11 caused by electric discharge hazard from the charging roller 46, particularly caused by AC components.

Specific examples of the materials for use as the solid lubricant 52 include solid hydrophobic lubricants such as stearates (e.g., zinc stearate, barium stearate, lead stearate, iron stearate, nickel stearate, cobalt stearate, copper stearate, strontium stearate, calcium stearate, cadmium stearate, and magnesium stearate); oleates (e.g., zinc oleate, manganese oleate, iron oleate, cobalt oleate, lead oleate, magnesium oleate, and copper oleate); palmitates (e.g., palmitic acid, cobalt palmitate, copper palmitate, magnesium palmitate, aluminum palmitate, and calcium palmitate); other fatty acid and salts thereof (e.g., lead caprate, lead caproate, zinc linolenate, cobalt linolenate, calcium linolenate, and cadmium lycolinolenate); waxes (e.g., candelilla waxes, carnauba waxes, rice waxes, Japan waxes, jojoba oils, bees waxes, and lanoline; etc.

Next, a description is given of a cleaning mechanism of a cleaning unit according to an example embodiment of the present patent application, e.g., the photoconductor cleaning unit 20 and the belt cleaning unit 70.

Figure 4:
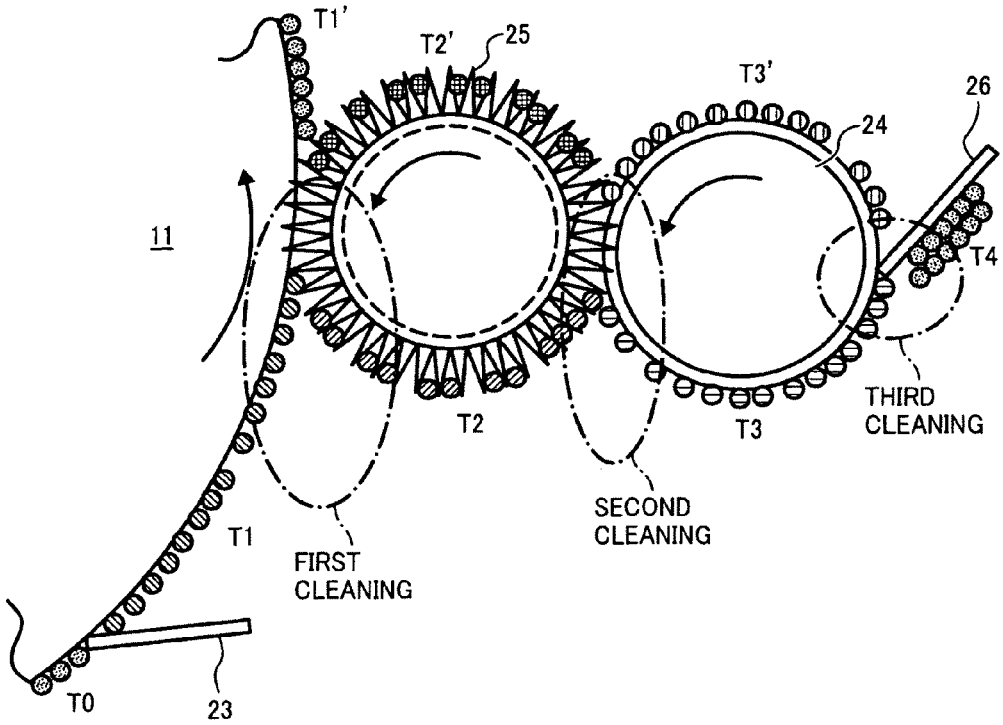
FIG. 4 is a schematic diagram for explaining an example of a cleaning mechanism of the photoconductor cleaning unit of FIG. 2.

FIG. 4 is a schematic diagram for explaining an example of the cleaning mechanism of the photoconductor cleaning unit 20.

With reference to FIG. 4, in a transfer step using a transfer bias, if a positive transfer bias voltage, for example, is applied to a toner with negative polarity after a development, all the toner may be transferred onto the recording medium such as a recording paper or an intermediate transfer belt 61. However, at a position where a transfer bias is applied, since an electric field is formed at a narrow gap between the photoconductor 11 and the intermediate transfer belt 61, separating discharge occurs, resulting in that both positive and negative polarities coexists in the residual toner T0 that has an amount of electric charge Q0 after the transfer.

Thus, the polarity control blade 23 is needed to unify the polarity of the toner T0 having positive or negative polarity to the toner T1 having either positive or negative polarity. The toner T1 has the amount of electric charge Q1.

An electrostatic force larger than the electrostatic force by which the toner is attached to the photoconductor 11 is applied to the brush roller 25 to attach the residual toner T1 to the brush roller 25 so as to clean as the residual toner T2. This step is called as a first cleaning step as shown in FIG. 4.

Next, the residual toner T2 adhering to the brush roller 25 is electrostatically transferred onto the toner collection roller 24 under the bias voltage applied to the toner collection roller 24. The toner on the toner collection roller 24 is referred to as the residual toner T3. This step is the second cleaning shown in FIG. 4.

The residual toner T3 transferred onto the toner collection roller 24 is to be swept or removed by the toner collecting blade 26. The toner removed by the toner collecting blade 26 is referred to as residual toner T4. This step is the third cleaning shown in FIG. 4.

Accordingly, the residual toner T0 remaining on the surface of the photoconductor 11 is collected as the residual or waste toner T4.

Figure 5:
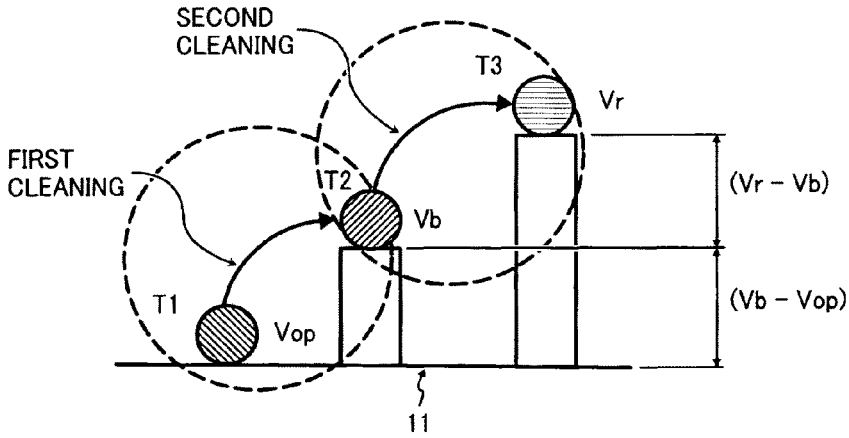
FIG. 5 is a schematic diagram for explaining a state in which a bias voltage needed for residual toner to transfer is applied.

FIG. 5 is a schematic diagram illustrating a toner transfer model to show a difference in electric potential between the electric charge of toner and the brush roller 25 for transfer of the residual toner in each of the first cleaning step and the second cleaning step.

As shown in FIG. 5, given that the surface potential of the surface of the brush roller 25 is "Vb", the surface potential of the photoconductor 11 is "Vop", and the surface potential of the toner collection roller 24 is "Vr", a difference between the surface potential Vb and the surface potential Vop is represented as (Vb−Vop) and a difference between the surface potential Vr and the surface potential Vb is represented as (Vr−Vb). Further, the toner T0 has the amount of charge Q0, the toner T1 has the amount of charge of Q1, and the toner T2 has the amount of charge Q2, respectively. An electrostatic force is specified by the product of the amount of charge of toner and electric field strength depending on depending on an electric potential difference. The distance of the electric field strength is not mentioned in here.

Therefore, the electrostatic force is represented by the product of the amount of charge Q0 or Q2 of the toner T0 or T1 and the difference in electric potential (Vb−Vop) or (Vr−Vb).

At this time, as shown in FIG. 4, the polarity control blade 23 may change the toner T0 on the surface of the photoconductor 11 with the amount of charge Q0 to the toner T1 having the amount of charge Q1. At this time, as shown in FIG. 5, the brush roller 25 collects the toner T1 by applying the potential difference (Vb−Vb). At this time, the toner T2 held on the brush roller 25 is slidably swept by the brush roller 25, the value does not vary much but affects to the amount of charge Q2.

Then, the toner T2 having the amount of charge Q2 and held on the brush roller 25 is collected to the toner collection roller 24 by applying the potential difference (Vr−Vb) with the toner collection roller 24.

The similar operations of collection of residual toner are repeated to the toner collecting blade 26, and the residual toner with uneven electrostatic force is transferred and collected at the third cleaning.

As described above, the polarity control blade 23 of the photoconductor cleaning unit 20 according to an example embodiment of the present patent application is a part to align the polarity of toner after transfer.

Since the toner after transfer includes the positive and negative polarities together, according to the polarity of voltage applied to the polarity control blade 23, either charge injection or electric discharging is performed to align the polarity of toner after transfer to a given polarity.

Another important function of the polarity control blade 23 is to regulate an amount of toner to be conveyed to the brush roller 25. Therefore, it is likely that, if a large amount of toner is conveyed to the brush roller 25, the brush roller 25 cannot remove the conveyed toner conveyed sufficiently.

Different from the surface of a metallic roller, for example, the surface of the brush roller 25 is covered by brush fibers and does not entirely contact with the surface of the photoconductor 11. When the toner held at a position where the brush fibers are implanted contacts the brush fibers, electrostatic force is exerted. By using the electrostatic force, the toner adheres to the brush roller 25 so that the photoconductor 11 is cleaned.

As described above, the planar-shaped elastomeric blade including urethane resin and the like has limitations of cleaning ability and cannot remove spherical, small toner sufficiently. To achieve the stable cleaning over a long period of time, a pressing force of the brush roller 25 onto the photoconductor 11 has to be 5 times or more compared with conventional pressing force. When such a great pressing force is applied, both the photoconductor 11 and the cleaning blade were damaged, which can result in degradation of durability.

However, it not necessary to apply such a great pressing force to reduce the toner amount on the photoconductor 11 if it is sufficient to perform the final cleaning only by the brush roller 25 without perfect cleaning. The toner amount to be removed by the elastomeric blade has to be limited to somewhere within the amount which the cleaning by the brush roller 25 can follow up. By so doing, no problem occurs to the image forming apparatus 1 as a whole. Therefore, functions required to the polarity control blade 23 include a function of charge injection to the toner and a function of shaking off the residual toner.

The material for the polarity control blade 23, which does not deteriorate the surface of the photoconductor 11 and is in contact with the entire surface thereof, is preferably an elastic material such as polyurethane, silicone, and fluorine-based rubber. In view of the required durability and capability of withstanding an environmental variation, it is preferable for the blade to have the performance as follows: hardness HS (JISA) of 65 degrees to 80 degrees, elastic modulus of 15% to 60% at 23 degrees Celsius, Young's modulus of 50 kg/cm$^2$ to 200 kg/cm$^2$, 100% modulus of 60 kgf/cm$^2$ to 200 kgf/cm$^2$.

As an electric characteristic of the polarity control blade 23, a conductive filler 31 and an ion conductor 32 are mixed as conductive agent. Example materials of the conductive filler 31 include metallic powder such as aluminum, nickel, stainless steel, palladium, zinc, iron, copper, silver and the like, composite metallic powder such as fiber, zinc oxide, tin oxide, titanium oxide and the like, carbon powders such as acetylene black, ketjen black, PAN-based carbon, pitch-based carbon and the like. These materials can be used alone or in combination of two or more materials.

Example materials of the ion conductor 32 include Na+ion, Li+ ion, Ag+ ion, Sb+ ion and so forth, any of which is in the ion state.

These conductive fillers 31 have a diameter of 0.1 micrometers [μm] or smaller in a primary particle condition and have a diameter of several micrometers [μm] or several tens of micrometers [μm] in a secondary particle condition after agglomeration.

These ion conductors 32 are in the ion state such as the Na+ ion state, it is contemplated that each particle is in a form of a very small atom.

The polarity control blade 23 can obtain a desired volume resistivity by adequately including both the conductive filler 31 such as carbon black, etc. and the conductive substance of the ion conductor 32 such as Na+ ion, etc.

Further, to control the amount of charge of toner to the negative polarity, an applied voltage to the blade is preferably −1,000V to −4,000V. The voltage lower than −1,000V results in poor efficiency of discharge, and the voltage higher than −4,000V causes the surface potential of the photoconductor 11 to be excessively negative so that the adhesion force of the photoconductor 11 with toner becomes stronger.

As the brush roller 25 provided in the photoconductor cleaning unit 20 according to an example embodiment of the present patent application, it is preferable to use a conductive brush produced by mixing an acryl, PET or polyester with a metallic core using a conductive material such as SUS and aluminum.

The conductive material is not dispersed onto the surface of the brush. It is necessary to take a core-in-sheath structure in which the conductive material is placed inside thereof and is not exposed on the surface. If the conductive material is exposed on the surface, the electric potential (represented by the reference character Vb in FIG. 5) cannot be maintained by the charge injection to the residual toner.

The electric resistance of the brush is preferably in a range of from $10^4\Omega$ to $10^9\Omega$. If the electric resistance is lower than $10^4\Omega$, the charge injection to toner is easy. If the electric resistance is higher than $10^9\Omega$, the electric field strength is weak, so that impression of high voltage is needed to secure electric field for attracting toner.

Moreover, in order to increase probability of contacting with the toner, a brush implantation density is also an important factor. The brush implantation density is preferably 70,000 hairs/inch$^2$ or more, more preferably 100,000 hairs/inch$^2$ or more.

Further, in order to increase contact probability, the brush is preferably rotated for one revolution in the counter direction to the photoconductor 11 at a linear velocity ratio of 0.5 or more. As another important factor, the inclination of the brush is considered. In general, a brush is said to be in an upright position. But if the brush is in an upright position, the tip portion thereof where a conductive material is exposed can easily be brought into contact with the toner. In view of this, it is preferable for the brush to be inclined, through inclination or brushing treatment of the brush, toward a direction in which the photoconductor 11 rotates, in order to avoid the direct contact between the toner and the conductive material.

If a voltage is applied only to the shaft of the roller, the surface potential of the toner collection roller 24 and the brush roller 25 is lowered when the surface of the brush comes in contact with the remaining toner. If the surface potential lowers, the toner cannot be transferred and is accumulated on the brush as the sufficient electric potential enough to transfer the toner cannot be maintained, covering the peripheral surface of the brush roller (roll formation). To avoid such a problem, it is necessary to apply a voltage which is about 200 V to about 500 V higher in potential than a voltage to be applied to the shaft as a surface potential of the brush roller 25. Likewise, in the toner collection roller 24, it is necessary to apply a voltage which is about 400 V to about 800 V higher in potential than a voltage to be applied to the shaft.

When a voltage higher than the voltage to be applied to the shaft is applied onto the roller surface, discharge deterioration due to the applied voltage on the surface occurs as damage, in addition to the deterioration by the blade in contact with the roller.

Such damages make the roller surface rough, reduces friction coefficient on the rough surface and reduces frictional force, resulting in the increase of pass-through of the residual toner from the blade tip.

As shown in FIG. 4, the residual toner represented by T3' passes between the toner collection roller 24 and the toner collection blade 26, the residual toner represented by T2' is reattached and transferred onto the intermediate transfer belt 61 with which the brush roller 25 is in contact, resulting in smearing on the belt, causing a background smear on the recording medium or the like (attaching of the toner represented by T1' in FIG. 4, for convenience).

Therefore, it is necessary for the toner collection roller 24 to be made of an insulating material which is hard to discharge, to properly maintain a surface roughness (i.e. surface smoothness), to be less damaged by the discharge or abrasion, and to have the above described structure.

The toner collection roller 24 is an insulating roller formed integrally by inserting a metallic material as a cored bar into a resin material. It is also possible to form the toner collection roller 24 as a rigid, insulating collecting roller whose cored bar is covered with any of PET, PVDF, PFA, or copolymer nylon formed as a tube.

In another method of forming the toner collection roller, the aluminum core is subjected to alumite treatment, Teflon (Registered) treatment, or fluorocarbon resin hardened alumite treatment to obtain an insulating metal surface. By coating the surface of the metallic material with an inorganic material such as ceramic and an organic material such as PTFE, polyimide and polycarbonate, an insulating collecting roller 24 can easily be obtained.

The thickness of the surface part of the toner collection roller 24 is preferably 1 mm or less, more preferably 0.5 mm or less. If the thickness of the toner collection roller 24 falls within the range, cracking or interfacial peeling off at the insulating layer of the toner collection roller 24 can be prevented which is due to the difference in expansion coefficient between the cored bar and the surface part thereof by an environmental change or change in diameter due to moisture.

The toner collecting blade 26 that is provided in the cleaning unit 20 according to an example embodiment of the present patent application is held in contact with the toner collection roller 24. The toner collecting blade 26 removes residual toner remaining on the toner collection roller 24. Further, the toner collecting blade 26 has a function of charge injection to the surface of the toner collection roller 24 to compensate the lowering of the surface potential at the toner collection roller 24. It is because the difference of potential between the brush roller 25 and the toner collection roller 24 lowers by removing the residual toner conveyed by the brush roller 25 by the toner collection roller 24.

Figure 6:
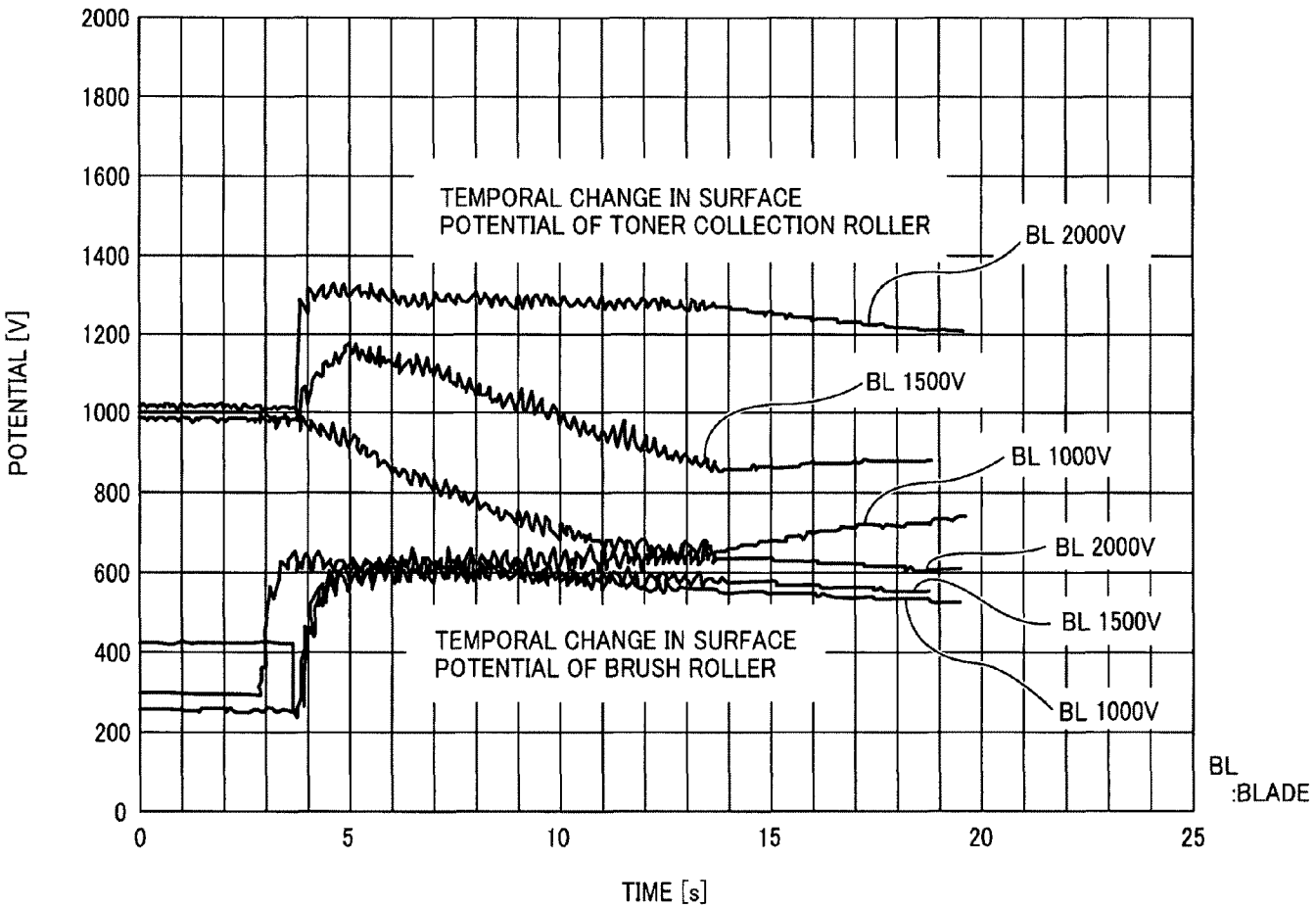
FIG. 6 is a graph showing time-course changes in surface potential of a toner collection roller according to applied voltages onto a surface of the toner collection roller.

FIG. 6 is a graph showing changes with time of surface potentials of the toner collection roller 24 and the brush roller 25 when various voltages are applied to the surfaces of the toner collection roller 24 and the brush roller 25. More specifically, the graph of FIG. 6 shows changes with time of surface potentials of the toner collection roller 24 and the brush roller 25 when a voltage of 700V is applied to the brush roller 25 and a voltage of 1,000V is applied to the toner collection roller 24 as the voltage applied to the toner collecting blade 26 is changed successively to 1,000V, 1,500V, and 2,000V.

As is clear from the results shown in the graph of FIG. 6, if the applied voltage is low, the surface potential on the toner collection roller 24 approaches with time to the surface potential of the brush roller 25. As a result, the difference in potential between the brush roller 25 and the toner collection roller 24 becomes too small to transfer the toner.

To achieve the above two functions, the toner collecting blade 26 is made from an elastomer such as polyurethane resin, silicone resin, and nitrile rubber, and is formed so as to secure the close contact with the toner collection roller 24. It is also required that a volume resistivity of the toner collecting blade 26 itself be $10\times10^{12}$ Ω·cm or less to ensure the charge injection to the toner collection roller 24.

To obtain conductivity, carbon, metallic filler, an ion conductor, or the like is added to the elastomer.

Now, a detailed description is given of the polarity control blade 23 provided in the photoconductor cleaning unit 20 according to an example embodiment of the present patent application.

Figure 7:
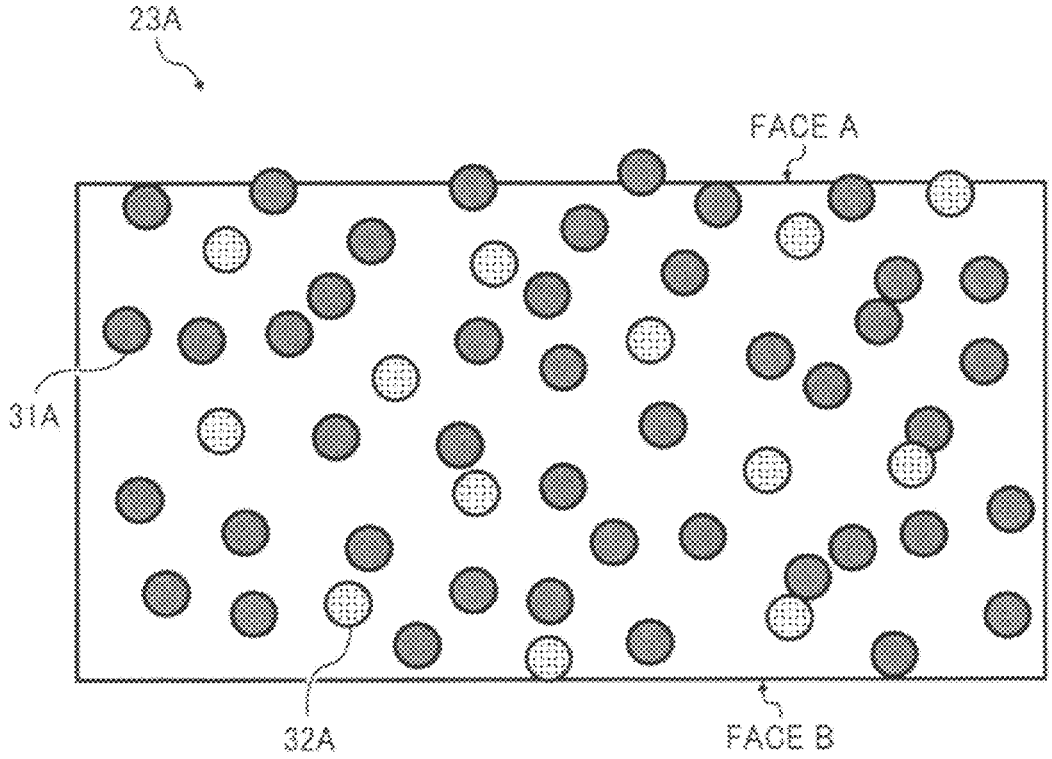
FIG. 7 BACKGROUND ART
FIG. 7 is a schematic diagram illustrating an inner structure of a related-art polarity control blade.

FIG. 7 illustrates a schematic diagram of an inner structure of a related-art polarity control blade 23A.

The polarity control blade 23A include at least conductive fillers 31A to form a conductive blade. The polarity control blade 23A can further include ion conductor 32A. In FIG. 7, the polarity control blade 23A includes both the conductive fillers 31A and the ion conductors 32.

In FIG. 7, an upper part of the polarity control blade 23A is a face A that contacts a photoconductor and a lower part thereof is a face B that attaches to a blade supporting plate 27A serving as a blade supporting member for supporting the polarity control blade 23A.

The polarity control blade 23A needs to control the polarity of toner and prevent a large amount of toner entering into the brush roller 25. The edge of a conductive blade including the conductive filler 31A has been nicked more frequently than that of an insulating blade that does not include the conductive filler 31A. The nicked edge of a conductive blade is caused by falling off of the aggregates of the conductive filler 31A.

With the nicked edge of the conductive blade, the residual toner passes under the polarity control blade 23A in streaks and enters the brush roller 25 without controlling the polarity sufficiently. Therefore, the brush roller 25 cannot collect the residual toner sufficiently, resulting in poor cleaning.

Figure 8A:
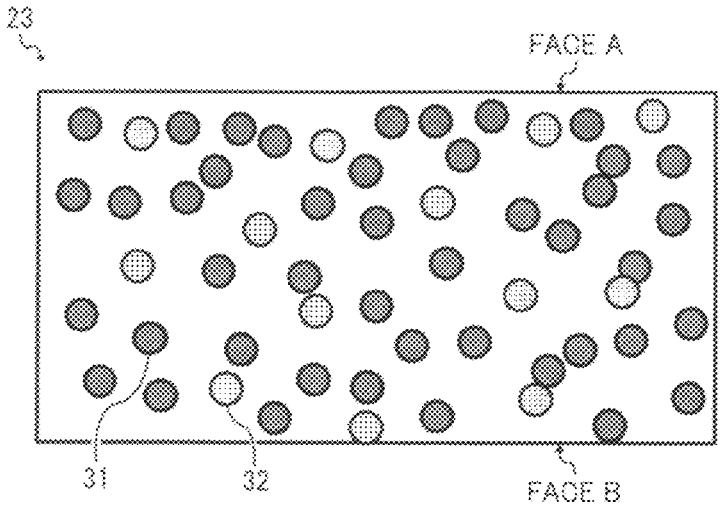
FIGS. 8A, 8B, and 8C are schematic diagrams illustrating an inner structure of a polarity control blade used in the cleaning unit of the image forming apparatus of FIG. 1.
Figure 8B:
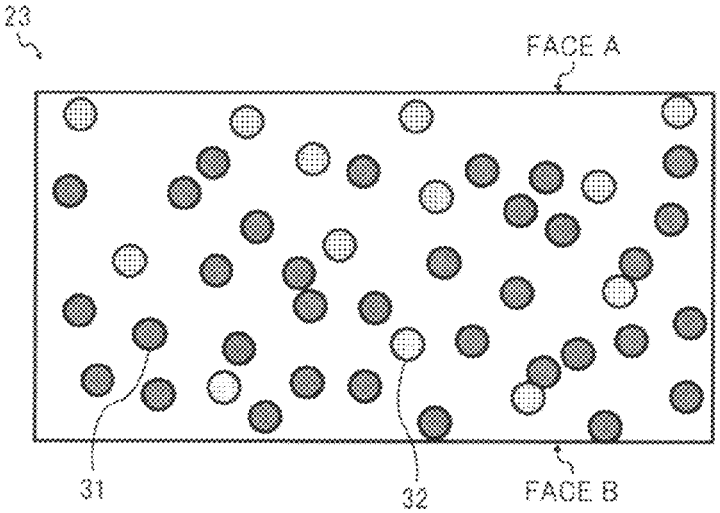
Figure 8C:
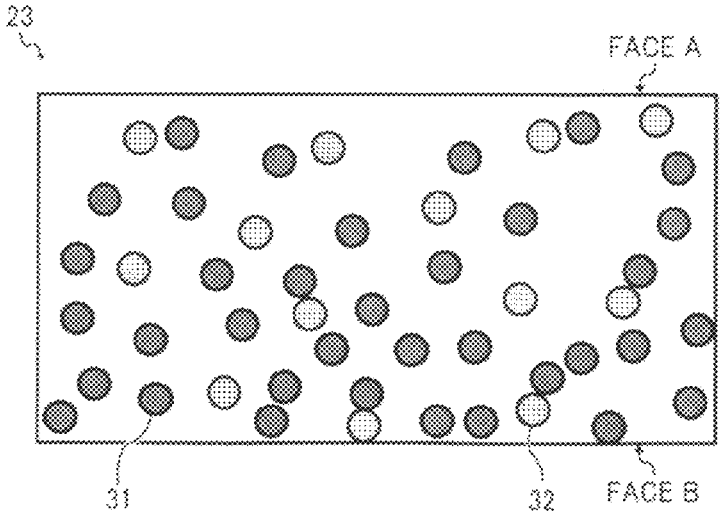

FIGS. 8A, 8B, and 8C are schematic diagrams illustrating various types of inner structure of the polarity blade 23 for the photoconductor cleaning unit 20 according to an example embodiment of the present patent application.

FIGS. 8A, 8B, and 8C show each cross-sectional view of a planar surface perpendicular to a longitudinal direction of the polarity control blade 23. An upper part of the polarity control blade 23 corresponds to a face A that contacts the photoconductor 11 and a lower part thereof corresponds to a face B that attaches to a blade supporting plate 27 serving as a blade supporting member to support the polarity control blade 23 to a main body of the image forming apparatus 1.

The polarity control blade 23 includes at least the conductive fillers 31 to form a conductive blade. Further, the polarity control blade 23 can include the ion conductors 32 together with the conductive fillers 31. The polarity control blade 23 shown in FIGS. 8A, 8B, and 8C includes both the conductive fillers 31 and the ion conductors 32.

In FIG. 8A, any of the conductive fillers 31 is not exposed on the face A of the polarity control blade 23 that contacts the photoconductor 11.

In the vicinity of the face A of the polarity control blade 23 in FIG. 8B, an area where the conductive fillers 31 do not reside.

In FIG. 8C, the polarity control blade 23 neither consists any of the conductive fillers 31 that is exposed on the face A thereof nor allows the conductive fillers 31 to reside in the vicinity of the face A thereof. Further, the polarity control blade 23 in FIG. 8C has different densities that become gradually greater toward the inner part thereof. Therefore, by controlling the amount of the conductive fillers 31 on the surface of the polarity control blade 23, the nicked edge of the polarity control blade 23 caused by losing the conductive fillers 31 can be prevented and achieve stable image forming.

FIGS. 9A, 9B, 9C, and 9D are schematic diagrams showing how to manufacture the polarity control blade 23 used for the photoconductor cleaning unit 20 according to an example embodiment of the present patent application.

The polarity control blade 23 used in the photoconductor cleaning unit 20 and the belt cleaning unit 70 according to an example embodiment of the present patent application can be fabricated using a centrifugal molding technique.

Figure 9A:
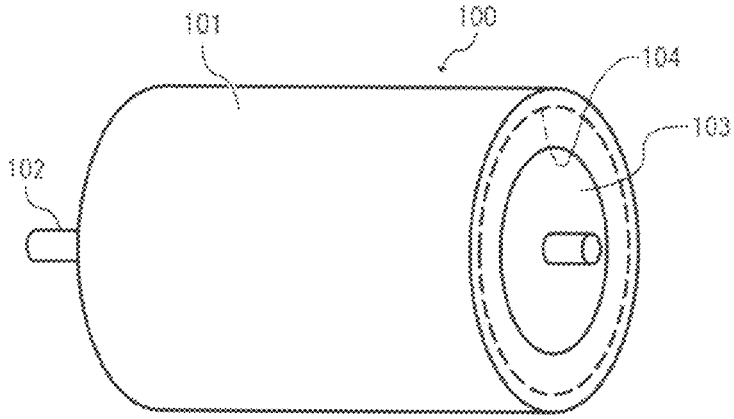
FIGS. 9A, 9B, 9C, and 9D are schematic diagrams illustrating a method for manufacturing the polarity control blade used in the cleaning unit of the image forming apparatus of FIG. 1.

FIG. 9A shows a schematic diagram of an appearance of a centrifugal molding machine 100.

The centrifugal molding machine 100 includes a molding body 101, a rotary shaft 102, an opening 103, an inner peripheral face 104, and a blade member 105.

The rotary shaft 102 that is connected to a drive source, not illustrated, is disposed at the center part of the molding body 101.

Compositions that consist essentially of a thermosetting resin such as a polyurethane resin including additive agent such as conductor is supplied inside the molding body 101 via the opening 103 mounted on the molding body 101. As the molding body 101 that is driven by the drive source rotates, the supplied compositions are dispersed uniformly over the entire inner peripheral face 104. Then, the dispersed compositions are heated by a heater, not illustrated, embedded in the molding body 101 so as to become rigid.

After the molding body 101 is stopped, the blade member 105 thus formed using the centrifugal molding technique is separated from the inner peripheral face 104 of the molding body 101.

Figure 9B:
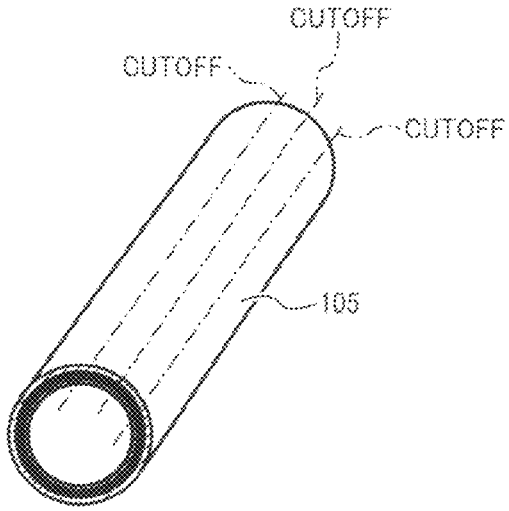

After being separated from the molding body 101, the blade member 105 is cut into a predetermined shape having a given size, as shown in FIG. 9B, so as to be used as the polarity control blade 23.

Figure 9C:
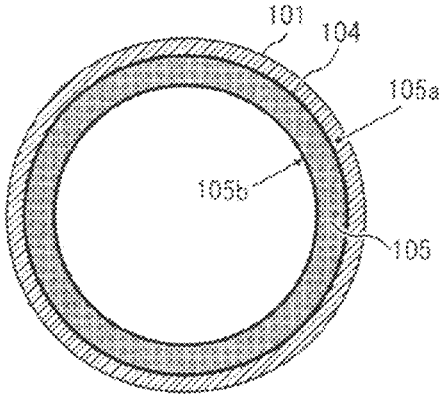

FIG. 9C is a cross-sectional view of a schematic diagram of the molding body 101 including rigid compositions.

Compositions consisting essentially of polyurethane resin having conductor such as the conductive fillers 31 and the ion conductors 32 are supplied to the molding body 101 of the centrifugal molding machine 100 and dispersed over the entire inner peripheral face 104 using a centrifugal force. Since the centrifugal force exerted to the conductive fillers 31 that are large in mass is greater than that exerted to the other compositions, the conductive fillers 31 move to the inner peripheral face 104 of the molding body 101 while being gradually hardened. With this action, the blade member 105 is formed to include a molding face 105*a* and an exposed face 105*b*. The molding face 105*a* contacts the inner peripheral face 104 of the molding body 101 and has a greater ratio of the conductive fillers 31. The exposed face 105*b* does not held in contact with any member but exposed to air or inert gas. Further, the conductive fillers 31 neither are exposed on the surface of the exposed face 105*b* nor reside in the vicinity of the surface thereof.

Further, the blade member 105 can be formed to have different densities from the exposed face 105*b* to the molding face 105*a*, i.e., to gradually become greater in quantity of the conductive fillers 31 from the exposed face 105*b* to the molding face 105*a*. The presence or absence of the conductive fillers 31 can be controlled by the number of centrifugal rotation, temperature, and time at molding, and further by viscosity of resin compositions to be supplied and amount of solvent.

Figure 9D:
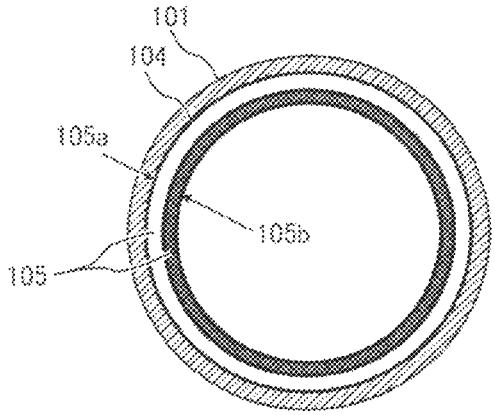

FIG. 9D is a cross-sectional view of a schematic diagram of the molding body 101 including rigid compositions different from those of FIG. 9C. That is, the blade member 105 shown in FIG. 9D has two layers of the rigid compositions while the blade member 105 shown in FIG. 9C has a single layer thereof. Details of the two-layer blade member 105 are described later.

Figure 10:
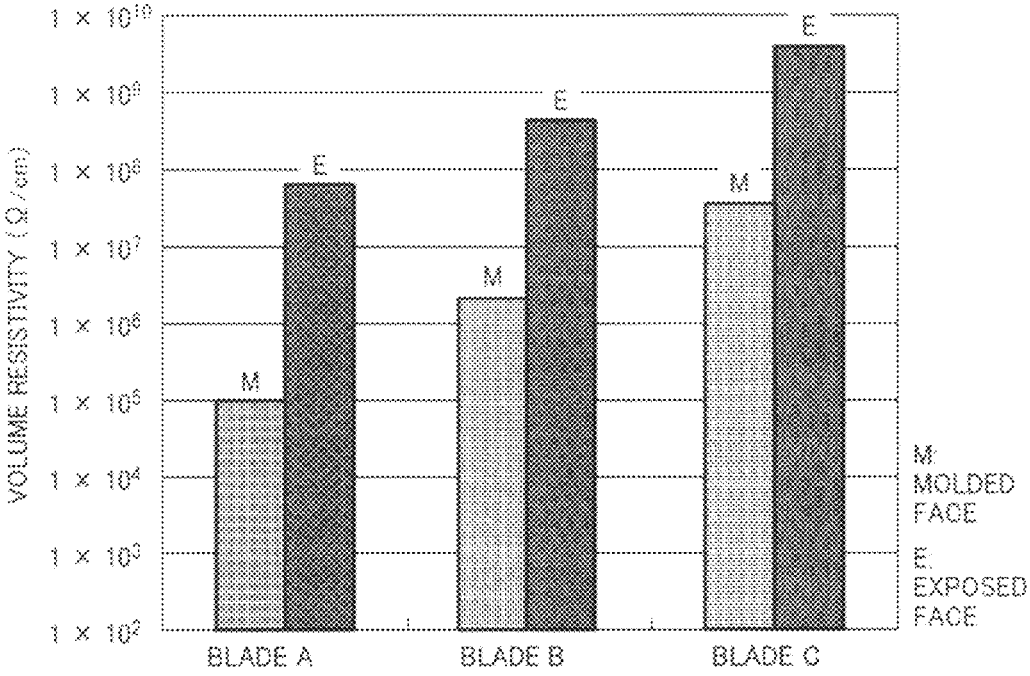
FIG. 10 is a graph showing volume resistivity of the polarity control blade that includes a carbon as a conductive filler and is manufactured using a centrifugal method.

FIG. 10 is a graph showing values of volume resistivity of polarity control blades that include carbons as the conductive filler and that are formed using the centrifugal molding technique.

In the graph of FIG. 10, the reference character "M" represents a molded face (e.g., the molded face 105*a*) and the reference character "E" represents the exposed face (e.g., the exposed face 105*b*). The molded face "M" and the exposed face "E" are opposite sides of the polarity control blade. Each bar under the reference character "M" indicates the volume resistivity on the molded face 105*a* and each bar under the reference character "E" indicates the volume resistivity on the exposed face 105*b*. Further, in the graph of FIG. 10, Blade A has 100% carbon content, Blade B has 50% carbon content, and Blade C has 30% carbon content.

As the graph of FIG. 10 shows, the volume resistivity increases as the amount of carbon content of the blade decreases. Further, at the blade edge that contacts the photoconductor 11, the volume resistivity of the exposed face 105*b* is greater by approximately $10^2$ than the volume resistivity of the molded face 105*a*. This difference may be caused by a gradual increase in quantity of the conductive filler 31 from the exposed face 105*b* to the molded face 105*a* of the blade member 105.

Figure 11:
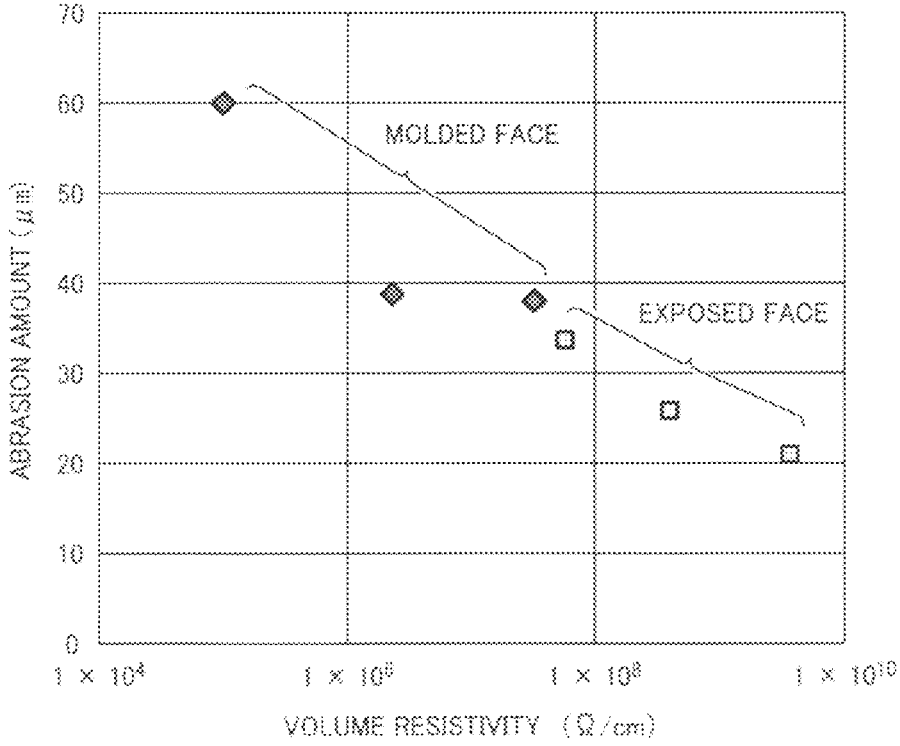
FIG. 11 is a graph showing a relation of the volume resistivity of the polarity control blade and the amount of abrasion of the leading end of the polarity control blade.

FIG. 11 is a graph showing a relation between the volume resistivity of the polarity control blade and the amount of abrasion at the leading edge of the polarity control blade.

A blade having the exposed face and the molded face of Blades A, B, and C was used as the polarity control blade 23 and, as a result, was found to have a negative correlation between the amount of abrasion and the volume resistivity.

The polarity control blade 23 serves to prevent a large amount of toner entering into the brush roller 25 and to control the polarity of electric charge of the toner passing through the cleaning area by performing charge injection or electric discharging to align the polarity of toner after transfer to a given polarity.

Figure 12:
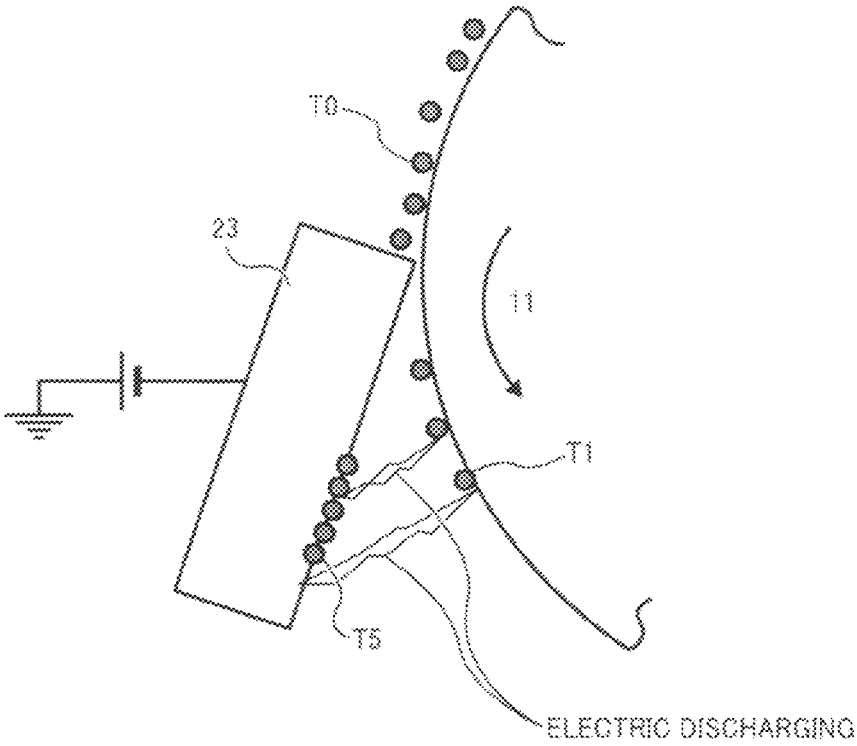
FIG. 12 is a schematic diagram for explaining the concept of charge polarity control performed by the polarity control blade.

FIG. 12 is a schematic diagram for explaining the concept of charge polarity control performed by the polarity control blade 23.

As shown in FIG. 12, electric discharge may occur between the face A of the polarity control blade 23 or 73 and the photoconductor 11 or the intermediate transfer belt 61. The electric discharging can generate Joule heat to increase the temperature in an area between the polarity control blade 23 and the photoconductor 11 or the intermediate transfer belt 61.

Specifically, when some amount of residual toner, which is represented as "T0" in FIG. 12, passes through the contact area between the photoconductor 11 (or the intermediate transfer belt 61) and the polarity control blade 23 (or the polarity control blade 73), the polarity of the residual toner T0 after the contact area is controlled. The polarity controlled toner is referred to with "T1" in FIG. 12. When the electric discharging occurs, the polarity controlled toner T1 can be attracted to the face A of the polarity control blade 23 to adhere thereto and melt. Then, as the temperature decreases, the polarity controlled toner T1 adhering to the face A of the polarity control blade 23 can solidify to fix thereto as fixed toner T5.

To prevent the solidification to develop the fixed toner T5 on the surface of the polarity control blade 23, it is necessary to hold down the current density of electric discharging that generates between the polarity control blade 23 and the photoconductor 11 or the intermediate transfer belt 61. Particularly, while the photoconductor 11 includes an insulating surface layer having a volume resistivity of $1.0\times10^{14}$ Ω·cm or greater and therefore the current density of electric discharging is kept low, the surface of the intermediate transfer belt 61 has a volume resistivity between $1.0\times10^{9}$ Ω·cm and $1.0\times10^{11}$ Ω·cm and therefore the resistance is low, which can easily produce an area having a high current density of electric discharging.

After a long-term duration test, the inventors of the present patent application have found that toner does not solidify when the volume resistivity is $1.0\times10^{7}$ Ω·cm.

The volume resistivity of the polarity control blade 23 that includes the conductive filler 31 and the ion conductor 32 can be determined based on the contained amounts of the conductive filler 31 and the ion conductor 32. However, the size of each particle of the ion conductor 32 is significantly smaller than the size of each particle of the conductive filler 31, and therefore the ion conductor 32 can come out of the surface of the polarity control blade 23 easily. This migration of the ion conductor 32 is a significant factor that triggers to decrease the joint strength of the polarity control blade 23 to the blade supporting plate 27.

To enhance the joint strength of the polarity control blade 23, various attempts, for example, application of primer to the attachment surface, formation of physical roughness on the surface thereof, etc. have been made but have not achieved to sufficient effects.

Figure 13:
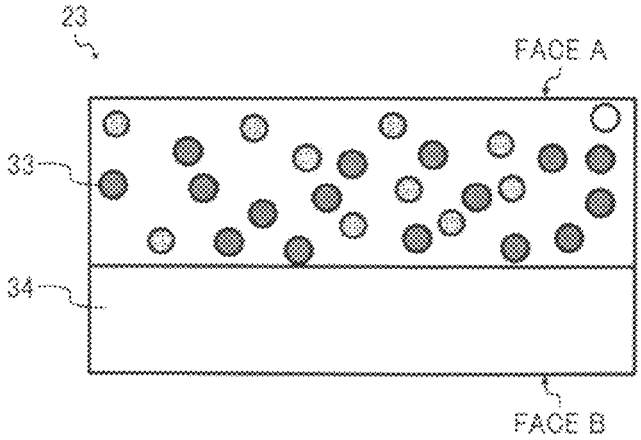
FIG. 13 is a schematic diagram of the layer-type polarity control blade having an insulating blade layer and a conductive blade layer.

FIG. 13 is a schematic diagram of an example of a layer-type polarity control blade having an insulating blade layer 34 and a conductive blade layer 33.

The polarity control blade 23 according to an example embodiment of the present patent application includes the insulating blade layer 34, which serves as a migration prevention layer, mounted on the attachment surface with respect to the blade supporting plate 27. The insulating blade layer 34 does not include the ion conductor 32 so that the ion conductor 32 may not migrate therefrom, and therefore the loss of the ion conductor can be prevented.

Thus, it is preferable that the polarity control blade 23 includes a layer-type blade including the conductive blade layer 33 and the insulating blade layer 34 and the attachment surface to the blade supporting plate 27 includes the insulating blade layer 34. This structure of the polarity control blade 23 can obtain good environment under the condition of high temperature that can easily cause the loss of the ion conductor 32 and stability and durability of joint strength of the polarity control blade 23 to use for a long period of time.

Referring back to FIG. 9D, a detailed description is given of how to fabricate the layer-type polarity control blade 23.

For fabrication of the blade member 105, compositions consisting essentially of a polyurethane resin having no or small amount of conductive agent such as the conductive filler 31 that cannot degrade the joint strength of the blade member 105 with respect to the blade supporting plate 27 are supplied. Then, the compositions are heated as the molding body 101 is rotated so that the compositions can be partially cured, which can form the insulating blade layer 34. Then, compositions consisting essentially of a polyurethane resin having conductive agent such as the conductive filler 31 and the ion conductor 32 is supplied to cure the blade member 105 so that the conductive blade layer 33 can be formed. Thus, the layer-type blade member 105 having two layers can be fabricated.

In this example embodiment of the present patent application, a boundary of the conductive blade layer 33 and the insulating blade layer 34 is clearly illustrated in FIG. 13. However, a structure of the polarity control blade 23, in which the boundary of the conductive blade layer 33 and the insulating blade layer 34 is not clear and the polarity control blade 23 has different densities of conductive agent from the conductive blade layer 33 to the insulating blade layer 34, can also be applied to the present patent application. The structure of the polarity control blade 23 can be further applied to the present patent application when the insulating blade layer 34 of the polarity control blade 23 is formed without the ion conductor 32 or can be formed to have conductivity by containing another conductive filler that does not come out from the surface of the polarity control blade 23.

Further, as noted above, the photoconductor cleaning unit 20 according to an example embodiment of the present patent application is used for the photoconductor 11.

The photoconductor 11 includes a resin layer having a filler dispersed therein covering a conductive supporting member, a photoreceptive layer including a charge generating element and a charge transporting element, which is formed over the surface of the resin layer, and a protective layer having a filler dispersed therein over the surface of the photoreceptive layer.

The photoconductor 11 may include a single layer including the charge generating element and the charge transport element as the photosensitive layer. However, the photoconductor 11 having a plurality of layers including a charge generating layer and a charge transport layer is more advantageous in sensitivity and durability.

The charge generating layer is produced by dispersing the charge generating substance together with a binder resin as needed in a proper solvent with a ball mill, an attritor, a sand mill, or an ultrasonic mill, applying the dispersed solvent on a surface of the conductive support or the insulating layer, and drying the applied solvent. The charge generating layer 212 may include the above-described charge generating substance dispersed in the binder resin as needed.

Examples of the binder resin include polyamide, polyurethane, an epoxy resin, polyketone, polycarbonate, a silicone resin, an acrylic resin, polyvinyl butyral, polyvinyl formal, polyvinyl ketone, polystyrene, polysulfone, poly-N-vinyl carbazole, polyacrylamide, polyvinyl benzale, polyester, a phenoxy resin, a vinyl chloride-vinyl acetate copolymer, polyvinyl acetate, a polyphenylene oxide, polyamide, polyvinyl pyridine, a cellulosic resin, casein, polyvinyl alcohol, and/or polyvinyl pyrrolidone. The amount of the binder resin ranges from about 0 parts by weight to about 500 parts by weight, and preferably ranges from about 10 parts by weight to about 300 parts by weight, with respect to the charge generating substance of about 100 parts by weight. The binder resin may be added before or after the charge generating substance is dispersed.

The charge transport layer is produced by dissolving or dispersing a charge transport substance and a binder resin in a proper solvent, applying the dispersed solvent on a surface of the charge generating layer, and drying the applied solvent. One or more of a plasticizer, a leveling agent, an antioxidant, and/or the like may be added as needed. The charge transport substance includes a hole transport substance and an electron transport substance.

Examples of the binder resin include thermoplastic resins and/or thermosetting resins (e.g., polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, a polyarylate resin, a phenoxy resin, polycarbonate, a cellulose acetate resin, an ethyl cellulose resin, polyvinyl butyral, polyvinyl formal, polyvinyl toluene, poly-N-vinyl carbazole, an acrylic resin, a silicone resin, an epoxy resin, a melamine resin, an urethane resin, a phenol resin, and/or an alkyd resin).

The protective layer may be formed on the photoreceptive layer. By having enhanced durability with the protective layer, the photoconductor 11 according to the present patent application can have high sensitivity without any defects and be effectively used.

Examples of such materials used for the protective layer include resins such as ABS resins, ACS resins, olefin-vinyl monomer copolymers, chlorinated polyethers, diallylphthalate resins (allyl resins), phenol resins, polyacetals, polyamides, polyamideimides, polyacrylates, polyallylsulfones, polybutylenes, polybutylene terephthalate, polycarbonates, polyarylates, polyethersulfones, polyethylenes, polyethylene terephthalates, polyimides, acrylic resins, polymethylpentenes, polypropylenes, polyvinylidene chlorides, and epoxy resins. Among these materials, polycarbonates and polyarylates are preferably used. A filler to be added to further improve the wear resistance of the protective layer includes fluororesin like polytetra fluoroethylene, and silicone resin, and these resins dispersed with inorganic materials like titanium oxide, tin oxide, potassium titanate, silica, etc. Quantity of the filler to be added to the protective layer depends on types of fillers and the electrophotographic process conditions under which the photoconductor 11 is used. However, at a rate of fillers with respect to total solid content on the top surface of the protective layer, the quantity of the filler is 5 wt % or greater, preferably 10 wt % or greater, and 50 wt % or smaller, preferably 30 wt % or smaller.

As described above, the technique for the photoconductor cleaning unit 20 according to an example embodiment of the present patent application can be applied to the belt cleaning unit 70 that includes the intermediate transfer belt 61. The intermediate transfer belt 61 receives respective single color toner images formed on the surfaces of the photoconductors 11 to sequentially overlay the single color toner images to form a color toner image.

The intermediate transfer belt 61, one of image bearing members, is obtained by adding a suitable amount of a conductive material such as a carbon black to a synthetic resin such as polyimide, polycarbonate, polyester, and polypropylene or various rubbers. The intermediate transfer belt 61 is set to have a volume resistivity of $10^6$ Ω·cm to $10^{14}$ Ω·cm.

The intermediate transfer belt 61 having the elasticity consists of a conductive elastic layer as a principal base material and a conductive protective layer. A material for the conductive elastic layer may be silicone rubber, NBR, CR, EPDM, or urethane rubber. A material for the conductive protective layer is not particularly limited, provided that it meets the following requirements: a reduction in coefficient of friction, stability of electric performance to environment, and improvement of cleanability of the residual toner due to a reduction in surface roughness. The material for the conductive protective layer is, for example, a paint obtained by dissolving or dispersing a fluorocarbon resin-based polymer such as polytetrafluoroethylene (PTFE), a copolymer (PFA) of tetrafluoroethylene and perfluoroalkylvinylether, and PVDF into an emulsion of an alcohol-soluble nylon, silicone, silane coupler or urethane resin emulsion, or an organic solvent.

The protective layer can be formed by applying the paint through a dip coating, spray coating, electrostatic coating, or roll coating. In addition, by performing a surface treatment or abrasion treatment to the protective layer, releasability, conductivity, abrasion resistance, surface cleanability and the like can be improved.

The toner used for the photoconductor cleaning unit 20 according to an example embodiment of the present patent application preferably has a shape factor SF-1 of from 100 to 150 and a volume average particle diameter of 6 micrometers [μm] or smaller.

In a recent hardcopy technology that relies on electrophotography, digitalization and multifunction have been realized, and a demand to achieve higher image quality has been increasing. Therefore, to enhance image reproducibility, it is required to reduce the size of a toner particle.

Further, there is a demand for energy-saving to reduce the environmental load in toner manufacturing. The melting-kneading-pulverization method has been widely used for the toner manufacturing. However, as the particle diameter of toner prepared by the melting-kneading-pulverization method becomes smaller, the productivity of toner can decrease and the manufacturing cost and the environmental load when manufacturing the toner can increase.

By contrast, a polymerization method, which is a recent toner manufacturing method, can control distribution of toner particles having a small and sharp particle diameter relatively easily. In addition, the polymerization method has attracted attention because it can control the structure of toner to include colorant, wax, etc.

However, in the regular process using the polymerization method, the shape factor SF-1 of toner is close to 100 and the roundness of the toner particle becomes higher, which causes a problem that a conventional blade cleaning technique cannot achieve good cleanability.

Therefore, the toner prepared by the polymerization method has been used for blade cleaning by providing a particle deformation process to decrease the sphericity of toner and increasing the SF-1 value. However, the particle deformation process can increase costs. When the value of the shape factor "SF-1" is 100, the particle has a perfect spherical shape. As the value of the "SF-1" increases, the shape of the particle becomes more elliptical.

As a toner particle has higher roundness, the toner particle is more likely to point-contact with another toner particle or the photoconductor 11. In this case, the adhesion force between these toner particles is weak, thereby making the toner particles highly flowable. Further, the adhesion force between the toner particle and the photoconductor 11 is weak, thereby making the transferability greater.

Therefore, even though the toner has the shape factor SF-1 in a range of from 100 to 150 and has difficulty in blade cleaning, the photoconductor cleaning unit 20 and the belt cleaning unit 70 can remove residual toner from the photoconductor 11 and the intermediate transfer belt 61, respectively, by controlling the polarity of toner and using the brush roller 25. Accordingly, the toner used for the photoconductor cleaning unit 20 and the belt cleaning unit 70 preferably has the shape factor SF-1 in a range of from 100 to 150 and the average particle diameter of 6 micrometers [μm] or smaller.

The shape factor "SF-1" is a parameter representing the roundness of a spherical substance (e.g., a toner particle) and is represented by the following equation:

$$\text{SF-1}=\{(MXLNG)^2/\text{AREA}\}\times(100\pi/4),$$

where "MXLNG" represents the maximum major axis of an elliptical-shaped figure obtained by projecting a toner particle on a two dimensional plane, and "AREA" represents the projected area of elliptical-shaped figure.

To find the shape factor SF-1, photographs of the base particles were taken using a scanning electron microscope, SEM (S-2700) manufactured by Hitachi, Ltd., and the obtained toner images that were magnified by 1,000 times were input into an image analyzer, LuzexAP made by Nireko Co. Analysis and calculations were performed on 100 base particles (or greater) according to the following equation. In the present patent application, as noted above, when the SF-1 value is 100 or smaller, toner can easily passes between the photoconductor 11 and the cleaning blade, and therefore it is likely to result in poor blade cleaning. By contrast, when the SF-1 value is 180 or greater, the ability of blade cleaning is good but the transfer efficiency tends to deteriorate, which may cause image quality degradation such as white spots.

The volume average particle diameter has no specific limitation and is selective according to the purpose. For the cleaning unit according to the present patent application (e.g., the photoconductor cleaning unit 20 and the belt cleaning unit 70), it is preferable that the toner has the volume average particle diameter of from 3 micrometers [μm] to 10 micrometers [μm], and it is more preferable that the volume average particle diameter of the toner is 6 micrometers [μm] or smaller.

If the volume average particle diameter of the toner is smaller than 3 micrometers [μm], the toner can melt and fix to the surface of a carrier particle in the process of a long-term agitation of the two-component toner in the developing unit, and therefore the charging ability of carrier can deteriorate.

By contrast, if the volume average particle diameter of the toner is greater 10 micrometers [μm], especially greater 6 micrometers [μm], high image quality in high resolution cannot be achieved, and therefore, when the toner contained in the developer is supplied, the irregularity of the toner particle diameter can be greater.

The following description is a brief description of a COULTER COUNTER and a flow particle image analyzer used for measuring the particles.

The average particle diameter and particle diameter distribution of a toner can be measured using an instrument such as COULTER COUNTER TA-II (from Coulter Electronics Inc.). In the present invention, a COULTER COUNTER TA-II is preferably used connecting with an interface (from The Institute of Japanese Union of Scientists & Engineers) and a personal computer PC9801 (from NEC Corporation) for outputting particle diameter distributions based on number and volume. An electrolyte includes 1% NaCl aqueous solution including a first grade sodium chloride. As the measurement method, the number and volume of toner particles in the toner suspension liquid are measured by the above instrument using an aperture of 50 μm to determine the number and volume distribution thereof.

The toner used in an example embodiment of the present patent application was obtained such that toner compositions consisting essentially of a bonding resin, a colorant that includes an urea-modified polyester resin having an urea group in an organic solvent in organic solvent are dissolved and dispersed and particulated in aqueous medium and caused polyaddition reaction of the modified resin, so that the toner compositions are particulated in aqueous medium and caused polyaddition reaction of the modified resin, and the solvent toner in the dispersed liquid is removed, washed, and dried. Other methods to manufacture spherical toner, a known polymerization method such as an emulsion polymerization method, a suspension polymerization method, a dispersion polymerization can be used. Further, the toner is thermally fused conventional pulverized toner particles thermally fused.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. A cleaning unit for removing particles of residual toner remaining on an image carrier after transfer, the cleaning unit comprising:

a brush roller disposed in contact with the image carrier to remove the residual toner remaining on the image carrier from the image carrier; and a polarity control member disposed in contact with the image carrier to control charge polarities of the residual toner remaining on the image carrier before the residual toner is removed by the brush roller, the polarity control member including a first surface where the polarity control member contacts the image carrier, a second surface where the polarity control member does not contact the image carrier, wherein the first surface that contacts the image carrier includes a conductive filler, wherein the first surface that contacts the image carrier is devoid of an externally exposed conductive filler.

2. The cleaning unit according to claim 1, wherein the polarity control member is a polarity control blade.

3. The cleaning unit according to claim 1, wherein the polarity control member is free of the conductive filler at the first surface of the polarity control member.

4. The cleaning unit according to claim 1, wherein the quantity of the conductive filler gradually increases from an area adjacent to the first surface of the polarity control member toward the second surface of the polarity control member.

5. The cleaning unit according to claim 1, wherein the polarity control member further includes an ion conductor, the cleaning unit further comprising:

a blade supporting member to support the polarity control member; and a migration prevention layer between the polarity control member and the blade supporting member to prevent loss of the ion conductor.

6. The cleaning unit according to claim 5, wherein the migration prevention layer is free of the ion conductor.

7. The cleaning unit according to claim 1, wherein a volume resistivity of the first surface of the polarity control member is $1.0\times10^7$ Ω·cm or greater.

8. The cleaning unit according to claim 1, wherein the polarity control member is a centrifugal molded member including at least the conductive filler and a thermosetting polyurethane resin.

9. The cleaning unit according to claim 8, wherein the polarity control member has an exposed surface that the image carrier contacts.

10. The cleaning unit according to claim 1, wherein the polarity control member is a centrifugal molded member including a composition of a thermosetting polyurethane resin and at least the conductive filler.

11. The cleaning unit according to claim 10, wherein the polarity control member has an exposed surface that the image carrier contacts.

12. The cleaning unit according to claim 1, wherein the polarity control member includes a thermosetting polyurethane resin, the polarity control member is a centrifugal molded member including a first composition of a non-conductive material and a second composition of a thermosetting polyurethane resin having at least the conductive filler.

13. A process cartridge removably installable to an image forming apparatus, the process cartridge integrally comprising:

an image carrier to carry an electrostatic latent image on a surface thereof; and the cleaning unit according to claim 1, wherein the image carrier and the cleaning unit are integrally incorporated into and supported in the process cartridge.

14. An electrophotographic image forming apparatus, comprising:

an image carrier to carry an electrostatic latent image formed on a surface thereof;

a developing unit to develop the electrostatic latent image formed on the surface of the image carrier into a visible toner image; and the cleaning unit according to claim 1.

15. The electrophotographic image forming apparatus according to claim 14, further including a process cartridge removably installable thereto, the process cartridge integrally including at least the image carrier and the cleaning unit.

16. The electrophotographic image forming apparatus according to claim 14, wherein the residual toner on the image carrier has a shape factor SF-1 of 100 to 150 and a volume average particle diameter of 6 micrometers or less.

* * * * *